US011359413B2

(12) United States Patent
Le

(10) Patent No.: US 11,359,413 B2
(45) Date of Patent: Jun. 14, 2022

(54) EXPANSION ADJUSTING DUAL ACTION DOOR LATCH ASSEMBLY

(71) Applicant: S.P.E.P. ACQUISITION CORP., Long Beach, CA (US)

(72) Inventor: Tam Le, Garden Grove, CA (US)

(73) Assignee: S.P.E.P. ACQUISITION CORP., Long Beach, CA (US)

( * ) Notice: Subject to any disclaimer, the term of this patent is extended or adjusted under 35 U.S.C. 154(b) by 295 days.

(21) Appl. No.: 16/656,441

(22) Filed: Oct. 17, 2019

(65) Prior Publication Data

US 2021/0115707 A1 Apr. 22, 2021

(51) Int. Cl.

| | |
|---|---|
| ***E05B 63/00*** | (2006.01) |
| ***E05B 9/02*** | (2006.01) |
| ***E05C 1/12*** | (2006.01) |
| ***E05C 1/14*** | (2006.01) |
| ***E05B 63/16*** | (2006.01) |

(52) U.S. Cl.

CPC ..... *E05B 63/006* (2013.01); *E05B 9/02* (2013.01); *E05C 1/12* (2013.01); *E05B 63/16* (2013.01); *E05C 1/14* (2013.01)

(58) Field of Classification Search

CPC ..... E05B 63/006; E05B 9/02; E05B 63/16; E05B 2001/0076; E05C 1/12; E05C 1/14; E05C 1/16; Y10S 292/30; Y10T 292/0994; Y10T 292/0971; Y10T 292/57; Y10T 292/30

See application file for complete search history.

(56) References Cited

U.S. PATENT DOCUMENTS

| | | | | |
|---|---|---|---|---|
| 2,483,368 | A * | 9/1949 | Ledin | E05C 1/08 292/165 |
| 3,751,949 | A * | 8/1973 | Castle | E05C 1/14 70/144 |
| 4,123,097 | A * | 10/1978 | Allemann | E05C 1/14 292/336.3 |
| 5,624,141 | A * | 4/1997 | Kuo | E05C 1/16 292/165 |
| 7,770,948 | B2 * | 8/2010 | Ellis | E05B 3/00 292/337 |
| 8,161,780 | B1 * | 4/2012 | Huml | E05C 9/004 70/107 |
| 8,449,003 | B2 | 5/2013 | Bunker, II et al. | |
| 2006/0284429 | A1 * | 12/2006 | Ebert | E05B 63/16 292/336.3 |
| 2008/0054651 | A1 * | 3/2008 | Wheatland | E05C 1/163 292/336.3 |
| 2012/0019013 | A1 * | 1/2012 | Bunker, II | E05B 3/10 292/336.3 |

* cited by examiner

*Primary Examiner* — Kristina R Fulton
*Assistant Examiner* — Matthew Thomas Evanko
(74) *Attorney, Agent, or Firm* — Karish & Bjorgum, PC

(57) ABSTRACT

A dual action latch, having a latch handle, an elongate bolt, a cam, a latch housing, and a biasing device, for installation on one side of door. The latch handle includes a lifting portion and a lever arm. The latch housing has a lever arm aperture through which the lever arm of the latch handle passes and a bolt guide for slidably receiving the elongate bolt. The latch handle is movably attached to the latch housing. With the latch handle moved, the lever arm withdraws the elongate bolt into the latch housing. Independently, when the cam is rotated by a separate handle on the other side the door, the cam plate likewise withdraws the elongate bolt into the latch housing.

25 Claims, 20 Drawing Sheets

EXPANSION ADJUSTING DUAL ACTION DOOR LATCH ASSEMBLY

FIELD OF THE INVENTION

The invention relates to door handle and latch sets, and particularly to a door expansion adjusting latch set particularly well suited for use in environments where doors are subject to swelling in thickness to thereby alleviate interference with the operation of the door handle and latch.

BACKGROUND OF THE INVENTION

There are a wide variety of door locks and latches available to secure doors in a closed position relative to a door frame. Many door locks and latches, such as used in structures, e.g., storage sheds with ingress/egress doors, can be operated by users whether inside or outside of a structure who wish to open the door. Often the type of action used to operate such door locks and latches on both sides of the door locks and latches are the same, for example rotation of the latch handles on both sides of the door. Sometimes there are different actions involved, such as pushing on a button on one side of the door latch and pulling a trigger or twisting a handle on the other side of the door latch.

Regardless of the type of action of operation, it is important that the latch provides consistent and reliable operation. In certain applications, such as in storage sheds made of wood and wood composite materials, including plywood, particle board, waferboard, OSB (Oriented Strand Board), and MDF (medium density fiberboard), the door material can, if exposed to rain, snow, and moisture, swell up and become thicker over time. Door latches designed to be opened from both sides of the door include an outside latch component mounted to the outside surface of the door and an inside latch component mounted to the inside surface of the door, with a mechanical connection between the two latches. If the door swells and becomes thicker, this can cause the mechanical connection between the outside latch component and the inside latch component to bind up, negatively impacting the operation of the latches.

In the past, latch designs were developed to accommodate such swelling, such as provided by U.S. Pat. No. 8,449,003 which teaches a door expansion adjusting handle and latch set for mounting on a door. It includes a first handle positioned on a first side of a door having a thickness, a shaft having two ends with one end fixedly connected to the first handle, a second handle positioned on a second side of the door and connected to the other end of the shaft by a nut. The nut permits the second handle and shaft to rotate relative to each other but prevents the second handle from being removed from the shaft. There is a latch that is operated by rotating the first handle and/or the second handle, and a coil spring that is interposed between the nut and the second handle to bias the first handle and the second handle towards or away from each other. If the thickness of the door increases or decreases, the coil spring will permit the second handle to move closer or further from the nut to accommodate the increase in door thickness. While this design has proven to be effective, it is limited to a latch design where both handles are operated by turning and requires some initial adjustment of the coil spring's tension. There is accordingly a need for a latch design that permits two different modes of operation of its two handles and does not require spring tension adjustments.

SUMMARY OF THE INVENTION

The present invention is a dual action latch, comprising: a latch handle comprising a lever arm; an elongate bolt comprising a distal end and a proximal end, and an elongate recess with a proximal end and a distal end; a cam comprising a boss and a cam plate, wherein at least a portion of the boss is sized to movably pass though the elongate recess of the elongate bolt; a latch housing comprising a lever arm aperture through which the lever arm of the latch handle passes, a bolt guide for slidably receiving the elongate bolt, the latch handle being movably attached to the latch housing, and the bolt guide being open at one end to permit the distal end of the elongate bolt to extend out of the latch housing; and a biasing device which biases the elongate bolt such that its distal end extends out of the open end of the latch housing, wherein when the cam is rotated the cam plate impinges on the elongate bolt and withdraws the elongate bolt into the latch housing, and wherein when the latch handle is moved the lever arm impinges on the proximal end of the recess of the elongate bolt and withdraws the elongate bolt into the latch housing.

In another embodiment the invention provides a dual action latch, comprising: a movable latch handle comprising a lever arm; an elongate bolt; a cam comprising a cam plate; a latch housing to which the latch handled is movably engaged, the latch housing comprising a lever arm aperture through which the lever arm passes, and a bolt guide for slidably receiving the elongate bolt, wherein the latch housing is open at one end to permit a distal end of the elongate bolt to extend outside of the latch housing; and a biasing device which biases the elongate bolt out of the open end of the latch housing, wherein when the cam is rotated the cam plate impinges on the elongate bolt and withdraws the elongate bolt into the latch housing, and wherein when the movable latch handle is moved the lever arm impinges on the elongate bolt and withdraws the elongate bolt into the latch housing In yet a further embodiment, the invention provides a dual action latch, comprising: a movable latch handle comprising a lever arm; an elongate bolt comprising a distal end and a proximal end, and an elongate recess with a proximal end and a distal end a cam comprising a boss with a shaft engagement and a cam plate, wherein at least a portion of the boss is sized to movably pass though the elongate recess of the elongate bolt; a latch housing to which the latch handled is movably engaged, the latch housing having a lever arm aperture through which the lever arm passes, a bolt recess for slidably receiving the elongate bolt with the bolt recess being open at one end to permit the distal end of the elongate bolt to extend outside of the latch housing, and a housing closure on a bottom of the latch housing, which housing closure has an aperture that is aligned with the shaft engagement adapter to permit external access to rotate the cam; and a biasing device which biases the elongate bolt out of the open end of the latch housing, wherein when the cam is rotated from outside of the latch housing the cam plate impinges on the elongate bolt and withdraws the elongate bolt into the latch housing, and wherein when the movable latch handle is moved the lever arm impinges on the proximal end of the recess of the elongate bolt and moves the elongate bolt into the latch housing and withdraws the elongate bolt into the latch housing.

These and other features of the invention are described below.

DETAILED DESCRIPTION

Figure 1:
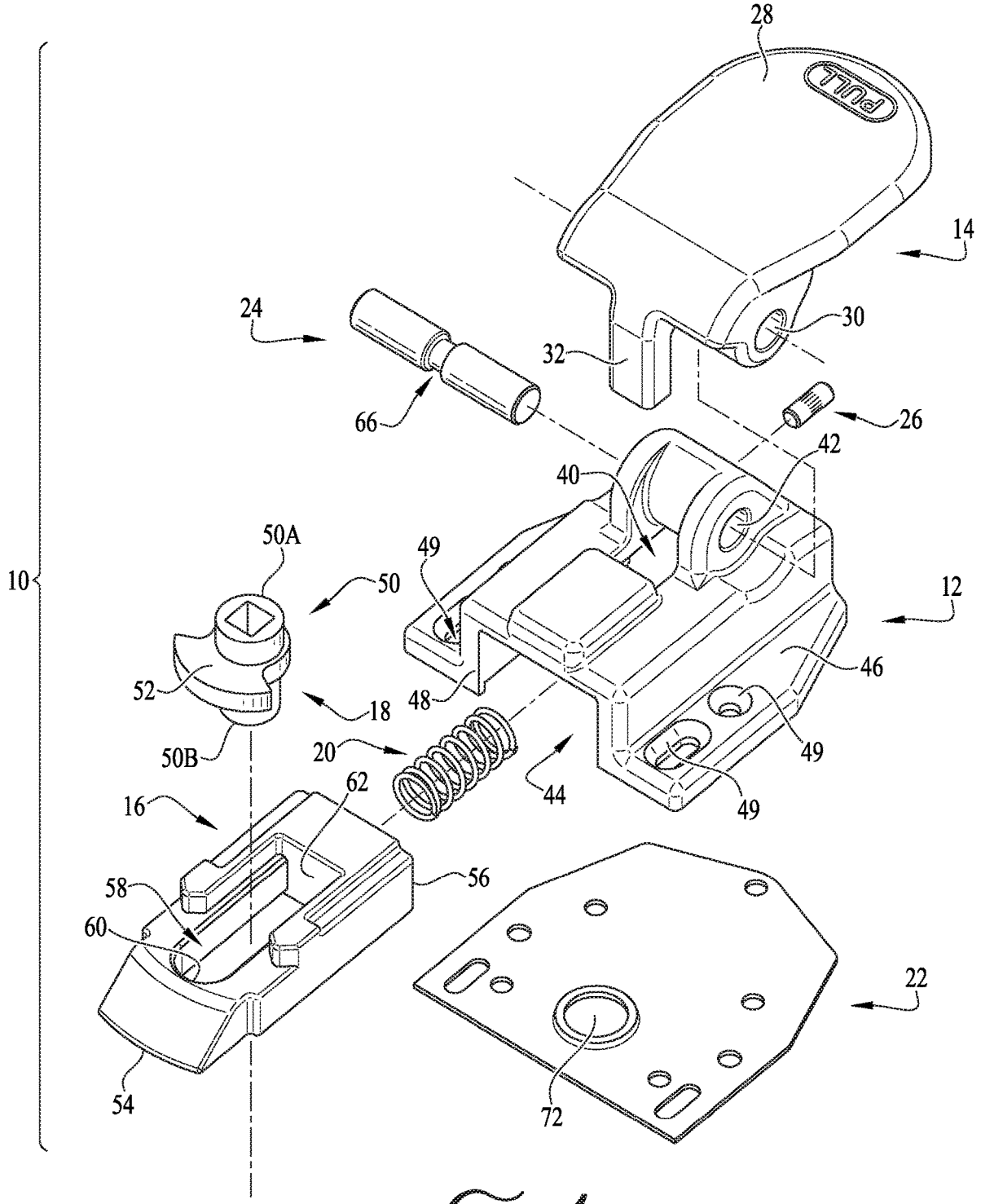
FIG. 1 is a front top exploded view of an exemplary embodiment of an expansion adjusting dual action door latch of the invention.
Figure 2A:
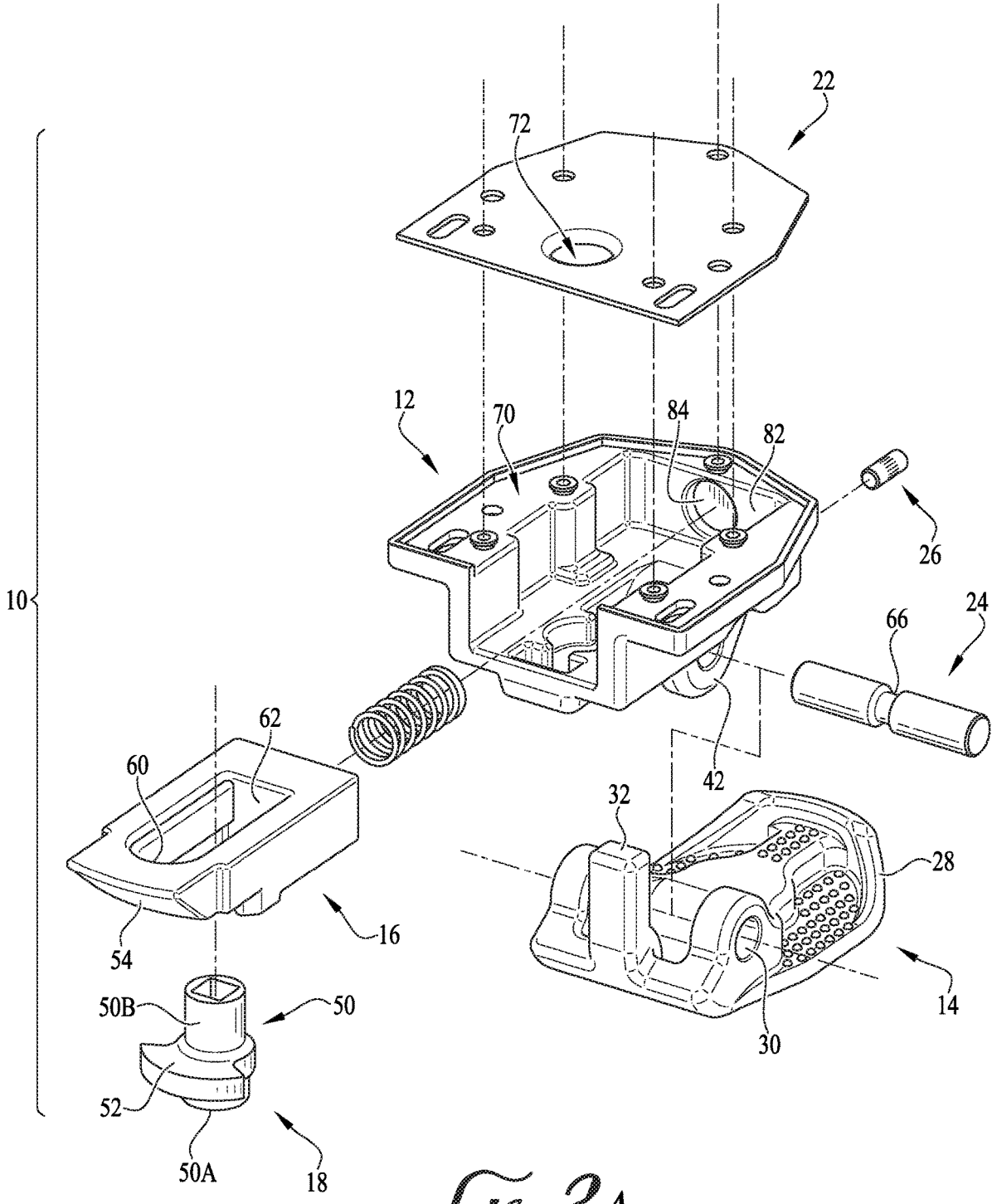
FIG. 2A is a front bottom exploded view of the expansion adjusting dual action door latch of FIG. 1.
Figure 2B:
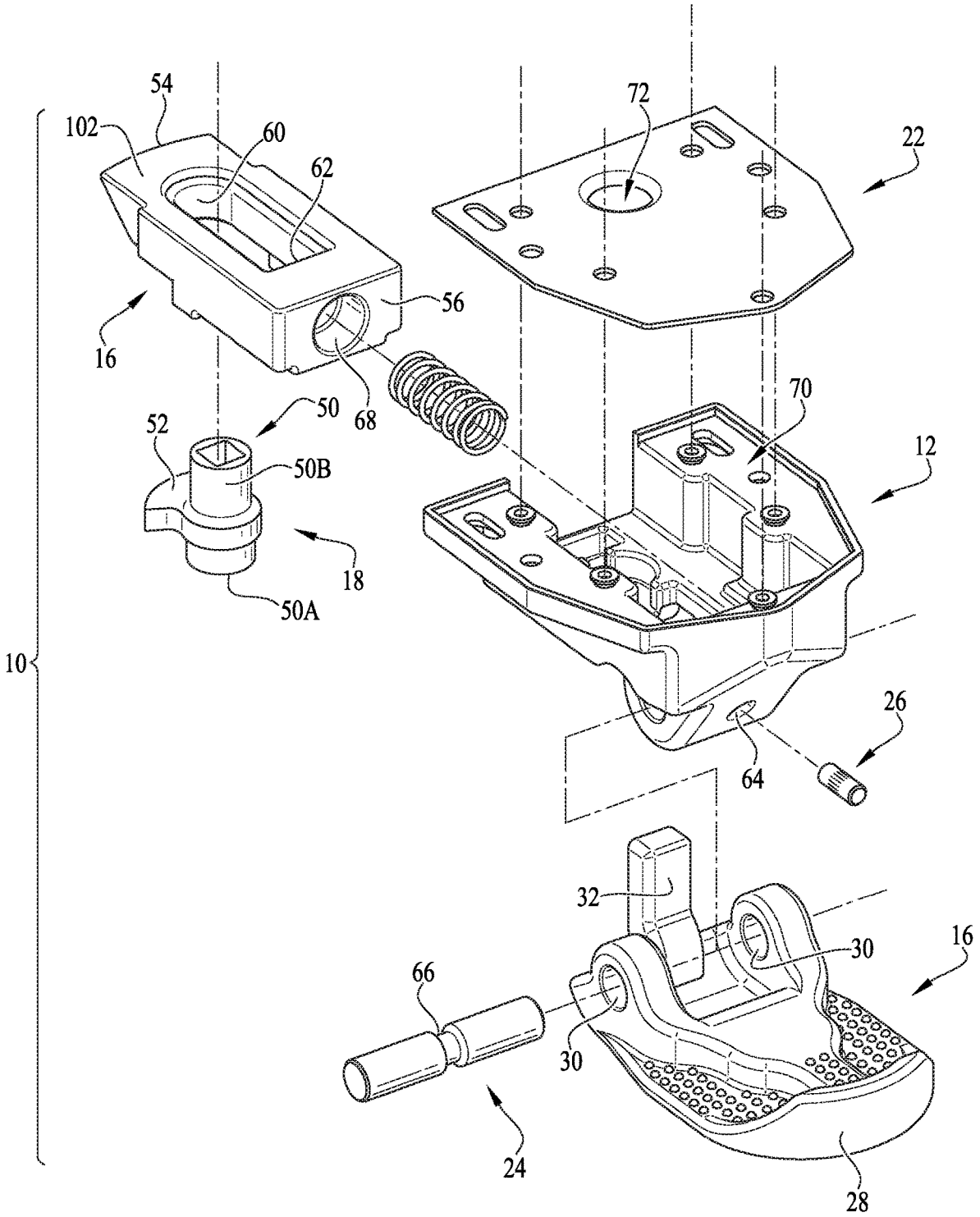
FIG. 2B is a rear bottom exploded view of the expansion adjusting dual action door latch of FIG. 1.

Turning first to FIGS. 1 and 2A and 2B, there are shown respectively a front top exploded view, a front bottom exploded view, and a rear bottom exploded view of an embodiment of an expansion adjusting dual action door latch 10 of the invention. The latch 10 includes a housing portion 12, a handle 14, a bolt 16, a cam 18, a biasing device 20, a housing cover plate 22, a pivot pin 24, and an optional pivot pin retainer 26. The biasing device 20 is shown as a coil spring but can comprise other known structures. The handle has a grip/lifting portion 28, a pivot engagement 30, and a lever arm 32. The housing portion 12 has a lever arm aperture 40 through which the lever arm 32 of the handle 14 can freely pass, a pivot pin engagement 42, a bolt guide 44 for slidably receiving the bolt 16, and a mounting structure 46 for attaching the housing 12 to a door 232 or door frame (see FIGS. 16, 17*a* and 17*b*). A series of apertures 49 are preferably formed in the mounting structure 46, which mounts structure 46 can comprise a rim area of the housing portion 12. The apertures 49 allow the latch 10 to be attached to a door with fixtures, e.g., screws (not shown). The bolt guide 44 is open at one end 48 of the housing portion 12 to permit the distal end 54 of the bolt 16 to extend therethrough. The cam 18 comprises a boss 50 with an upper boss portion 50A and a lower boss portion 50B, and a cam plate 52. The boss 50 is perpendicular to the cam plate 52. The bolt 16 is preferably elongate and has a distal end 54 a proximal end 56 and has an elongate recess 58 is formed therein. The distal end 54 of the bolt 16 is preferably beveled. The elongate recess 58 has a distal end 60 (preferably semi-cylindrical) and a proximal end 62 (preferably flat). A spring engagement 68 is located at proximal end 56 of the bolt 16 and can comprise a well that is sized to receive an end of the biasing device (coil spring) 20. When assembled, the pivot pin 24 will movably engage the pivot engagement 30 of the handle 14 to the pivot pin engagement 42 of the housing portion 12 to thereby allow the handle 14 to pivot relative to the housing portion 12. The optional pivot pin retainer 26 will friction fit into an aperture 64 (see FIG. 2B) in the housing portion 12 and freely fit within an optional groove 66 formed in the pivot pin 24. The housing cover plate 22 closes up an open bottom 70 of the housing when all parts of the latch 10 are assembled. The housing cover plate 22 has a cam boss access aperture 72.

Figure 3:
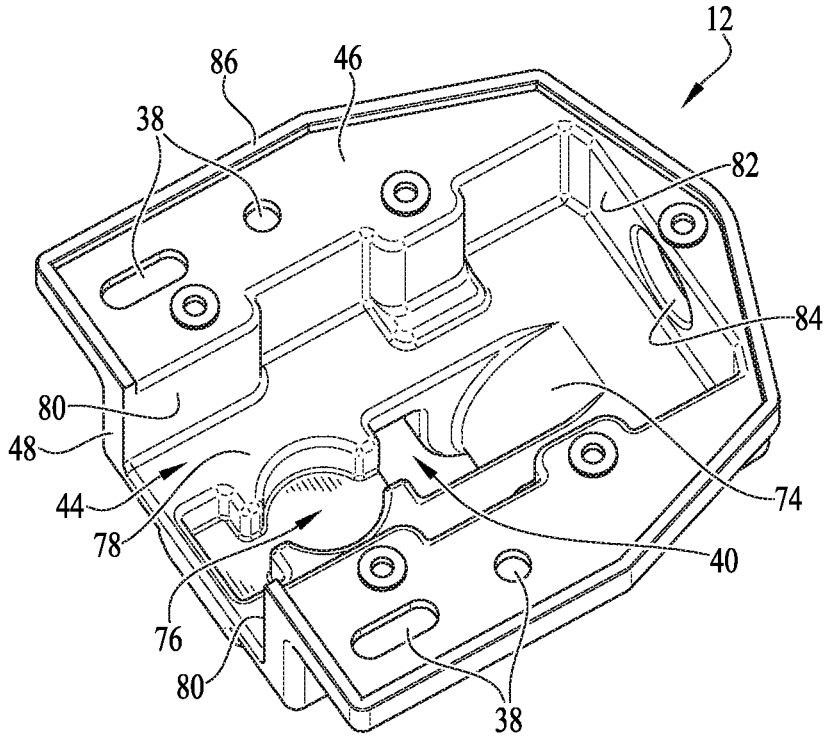
FIG. 3 is a front bottom view of the housing portion of the expansion adjusting dual action door latch of FIG. 1.
Figure 4:
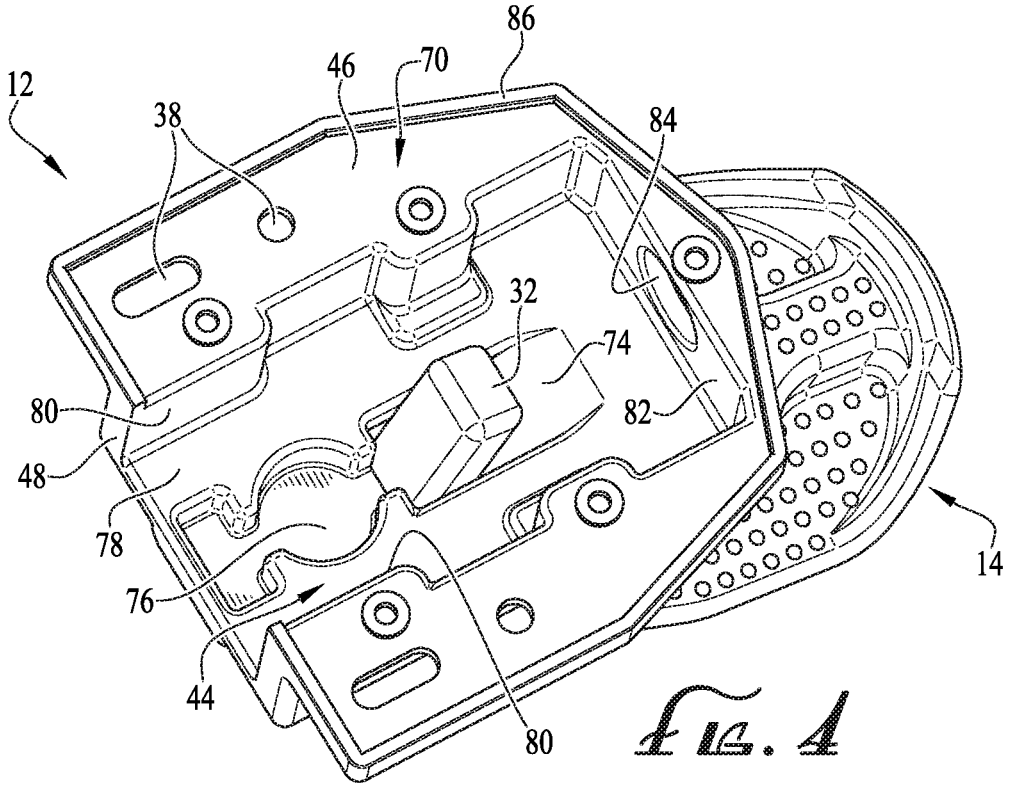
FIG. 4 is a front bottom perspective view of the housing and handle portions of the expansion adjusting dual action door latch of FIG. 2.
Figure 5:
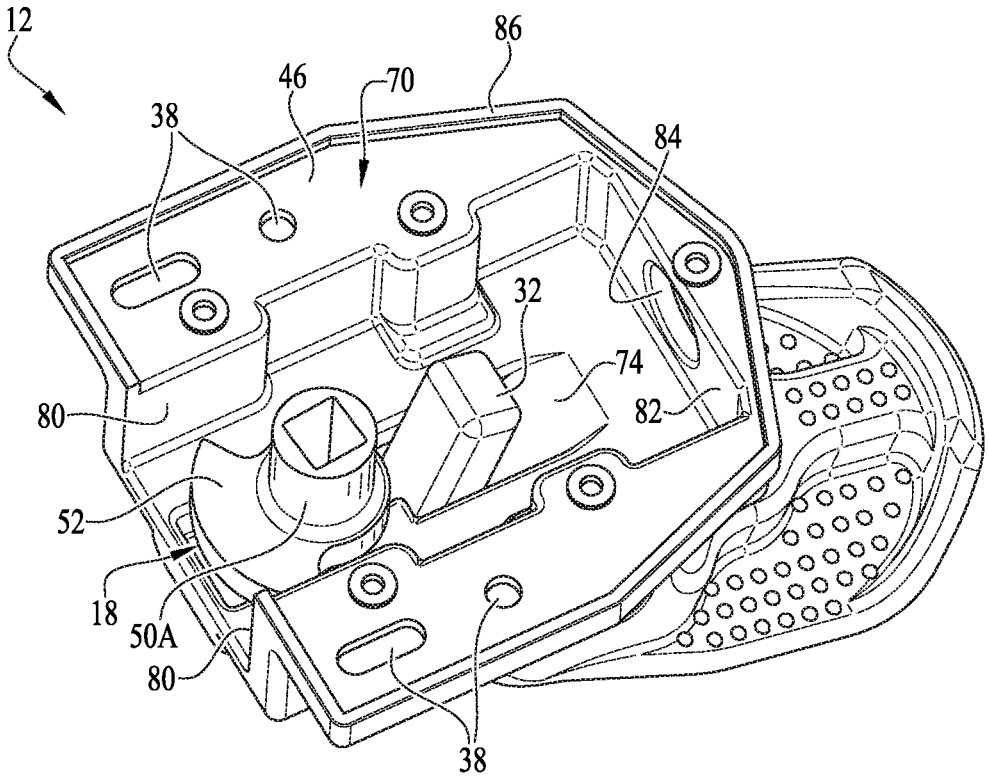
FIG. 5 is a front bottom perspective view of the housing, handle, and cam of the expansion adjusting dual action door latch of FIG. 4.

FIGS. 3, 4 and 5 are rear bottom perspective views of the housing portion 12 alone (FIG. 3), the housing portion 12 and the handle 14 (FIG. 4), and the housing portion 12, the handle 14 and the cam 18 of the expansion adjusting dual action door latch of FIG. 1. As can be seen, the housing portion 12 has includes the lever arm aperture 40 through which the lever arm 32 of the handle 12 can freely pass. Leading to the lever arm aperture 40 is an arched ramp surface 74 which permits the lever arm 32 of the handle 14 to make its arched movement in the housing portion 12 as the handle 14 is lifted. The housing has a cylindrical well 76 formed in a bottom wall 78 of the bolt guide 44, the cylindrical well 76 being adapted to rotatably retain the upper boss portion 50A of the cam 18, wherein the cam plate 52 will ride on bottom wall 78. The bolt guide 44 has opposing side walls 80 and a closed end wall 82 opposite the open end 48 of the housing portion 12. Formed in the end wall 82 is a biasing member engagement 84, which can comprise a cylindrical well sized to receive an end of the spring. The open bottom 70 of the housing portion 12 can include a raised perimeter 86, and the open bottom 70 will preferably be sized and shaped to accept the housing cover plate 22, which can be permanently attached to the housing when the latch 10 is fully assembled (not shown).

Figure 6A:
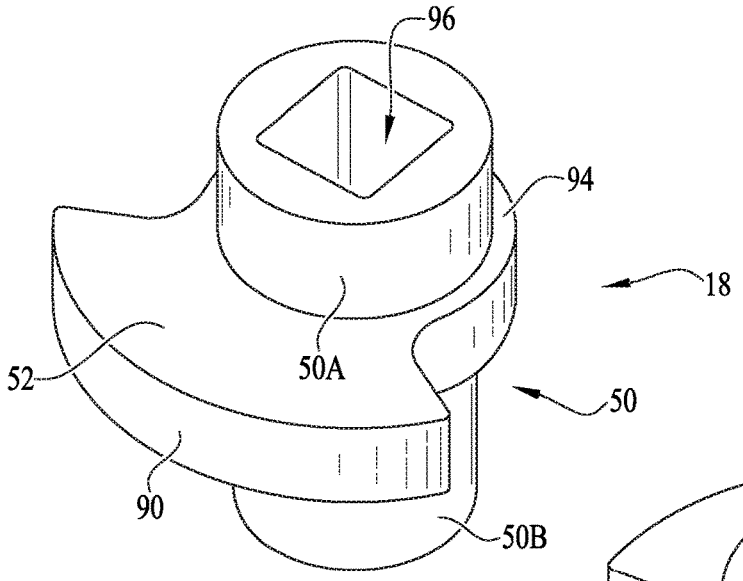
FIG. 6A is a front perspective view of the cam of the expansion adjusting dual action door latch of FIG. 1.
Figure 6B:
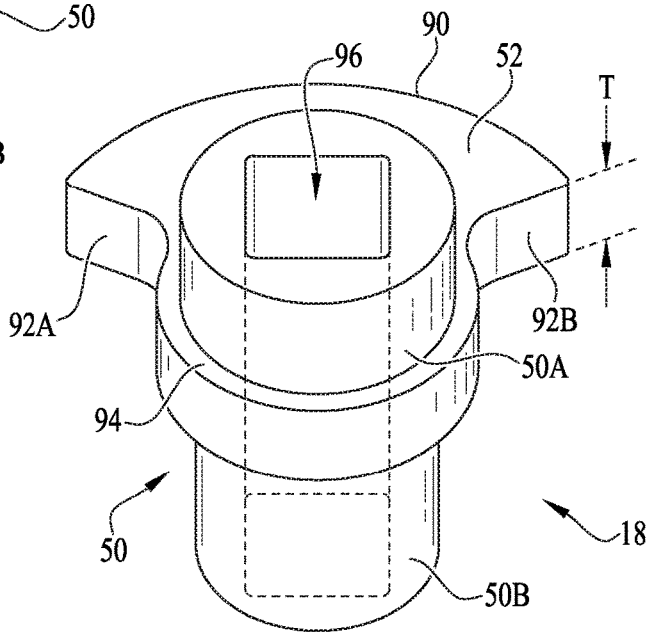
FIG. 6B is rear perspective view of the cam of the expansion adjusting dual action door latch of FIG. 6A.
Figure 6C:
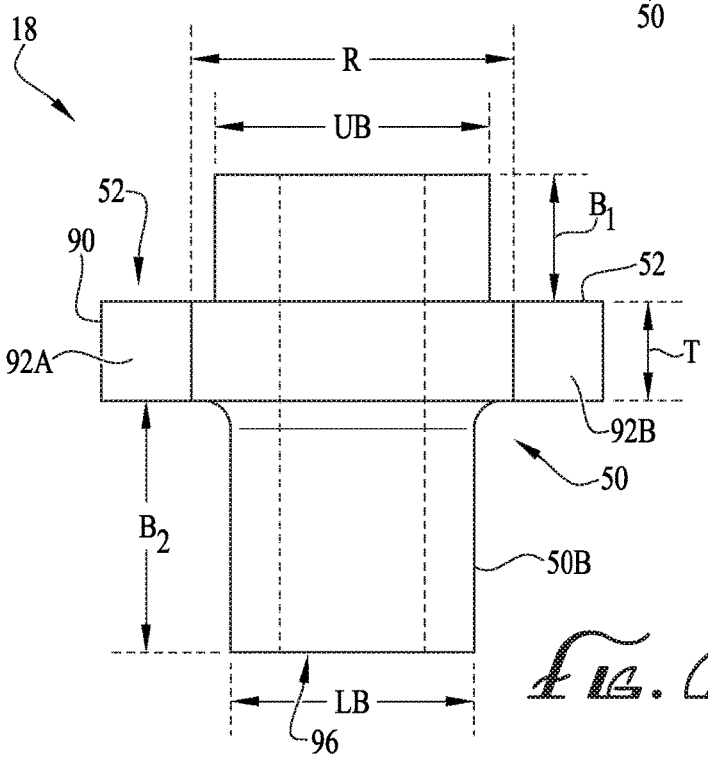
FIG. 6C is a rear view of the cam of the expansion adjusting dual action door latch of FIG. 6A.

FIGS. 6A-C are various views of the cam 18. As already noted, the cam 18 comprises a boss 50 and a cam plate 52 that is perpendicular to the upper boss portion 50A and the lower boss portion 50B. The cam plate 52 is in the form of a section of a disc with a semi-cylindrical perimeter wall 90 with thickness "T". There are two angled cutout ends 92A and 92B where the cam plate 52 narrows down to a perimeter ridge 94, which perimeter ridge 94 continues all around a transition area between the upper boss portion 50A and the lower boss portion 50B where cam plate 52 is otherwise absent. The perimeter ridge 94 has the same thickness "T" as the cam plate 52 and is a continuation of the cam plate 52. The upper boss portion 50A has a height "$B_1$" and a diameter "UB", and the lower boss portion 50B has a height "$B_2$" and a diameter "LB". In the rear view of the cam 18 of FIG. 6C, from side to side of the perimeter ridge 94, the width thereof is width "R", which is larger than the diameter UB of the upper boss portion 50A and larger than the diameter LB of the lower boss portion 50B. Passing at least through the lower boss portion 50B (and also preferably through the upper boss portion of 50A) is a passageway 96. In the embodiment shown, the passageway 96 has a square cross-section, but the passageway can have other non-circular cross sectional shapes that allow a turning shaft to slidably pass therethrough and provide a turning force on the cam as will be described further below with reference to FIGS. 16, 17A and 17B.

Figure 7A:
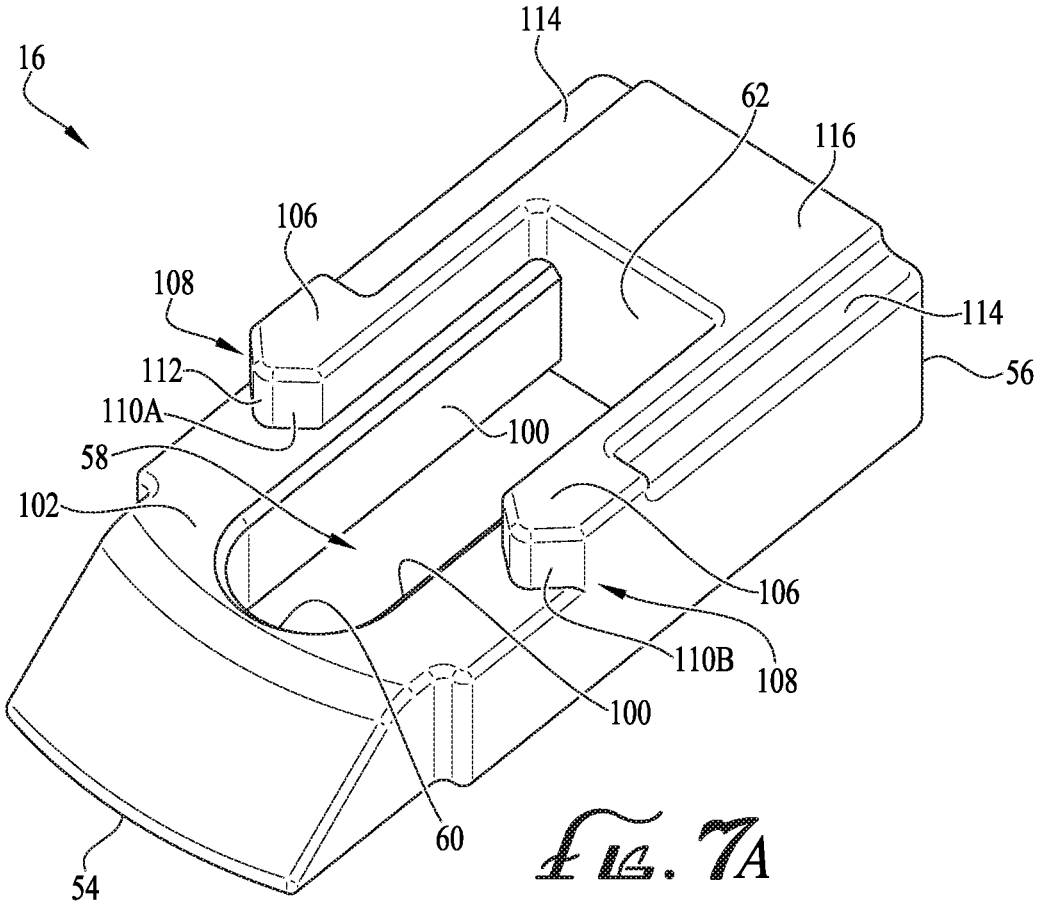
FIG. 7A is a top front perspective view of the bolt portion of the expansion adjusting dual action door latch of FIG. 1.
Figure 7B:
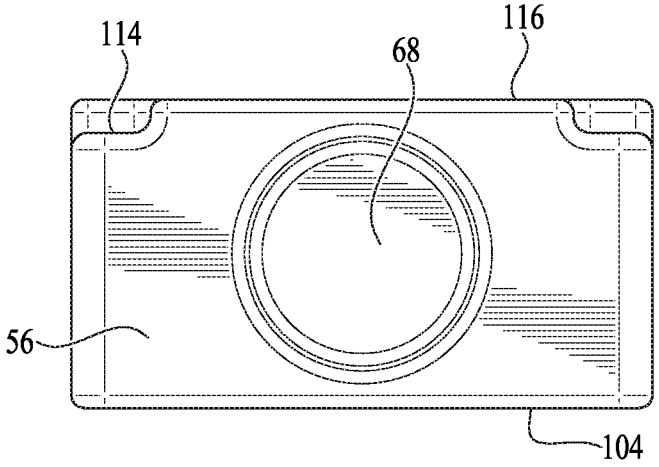
FIG. 7B is a rear view of the bolt portion of FIG. 7A.

FIG. 7A is a front top perspective view of the bolt 16 of the expansion adjusting dual action door latch 10 of FIG. 1, and FIG. 7B is a proximal end view of the bolt 16. As noted above, the bolt 16 is preferably elongate and has a distal end 54 a proximal end 56 and an elongate recess 58 is formed therein. The well-shaped spring engagement 68 is shown at the proximal end 56. The elongate recess 58 has a distal end 60 and a proximal end 62, and the elongate recess 58 preferably has perpendicular side walls 100. The distal end 60 is preferably semi-cylindrical and the distance between the perpendicular side walls 100 is adapted to allow the lower boss portion 50B of the cam 18 to freely pass therethrough. When the lower boss portion 50B of the cam 18 is passed into the elongate recess 58, the lower boss portion 50B can thus rotatably ride against the semi-cylindrical distal end 60 of the elongate recess 58, and the cam plate 52 and the perimeter ridge 94 cam ride on a top surface 102 of the bolt 16. The distal end 54 of the bolt 16 preferably is beveled and slanted down and out from the top surface 102 of the bolt 16 to a bottom surface 104 of the bolt 16. The bolt 16 further includes two parallel guide rails 106 that run next to the side walls 100 of the elongate recess 58. Each guide rail 106 has a V-shaped distal end 108 with an inside surface 110A and an outside surface 110B which intersection at a forward point 112. The guide rails 106 merge into a proximal section 116 at the proximal end 56 of the bolt 16. Each guide rail 106 can include an elongate slide slot 114 formed along top outside edges of the guide rails, which elongate slide slots 114 extend from the proximal end 56 of the bolt to behind the forward point 112 of the guide rail 106. The guide rails 106 are raised up above the top front surface 102 of the bolt 16 by a distance that is about the same as the thickness "T" of the cam plate 52 of the cam 18.

Figure 8A:
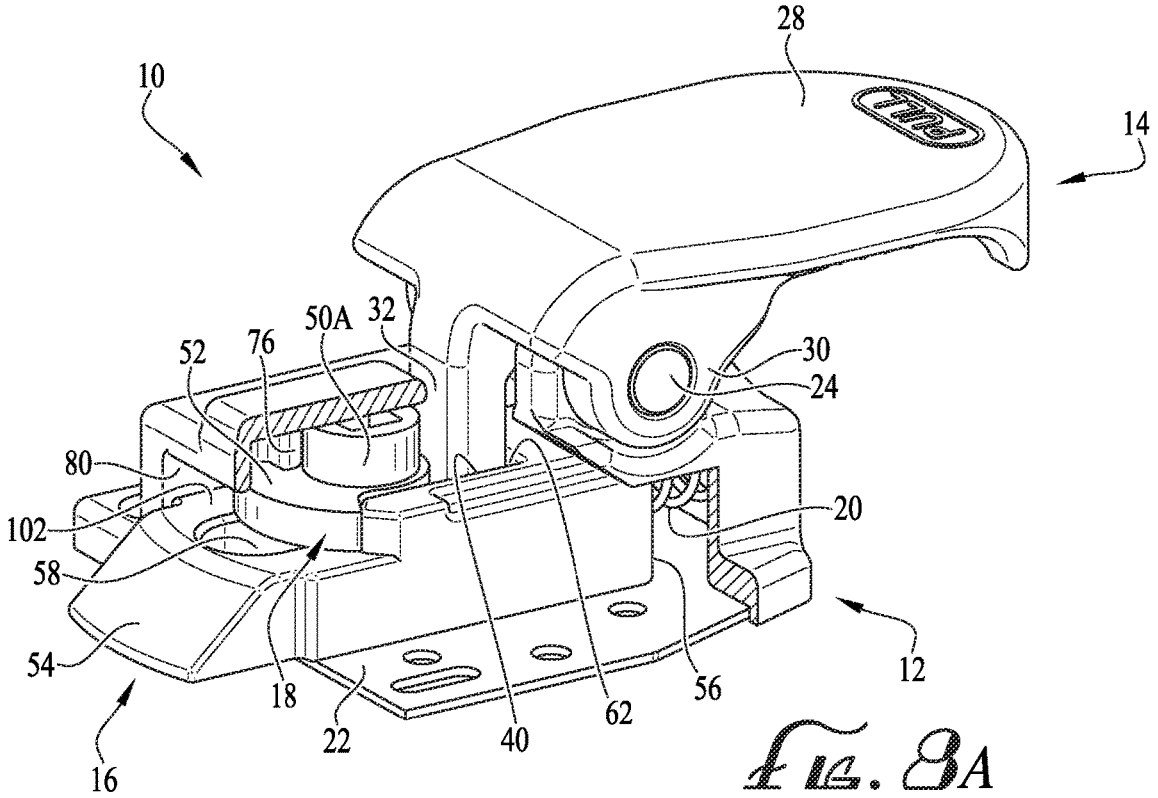
FIG. 8A is a front top perspective view of the expansion adjusting dual action door latch of FIG. 1 as assembled, with its housing portion partially cut away to reveal the cam and the bolt portion, with the handle not lifted up and with the bolt fully extending out of the housing.
Figure 8B:
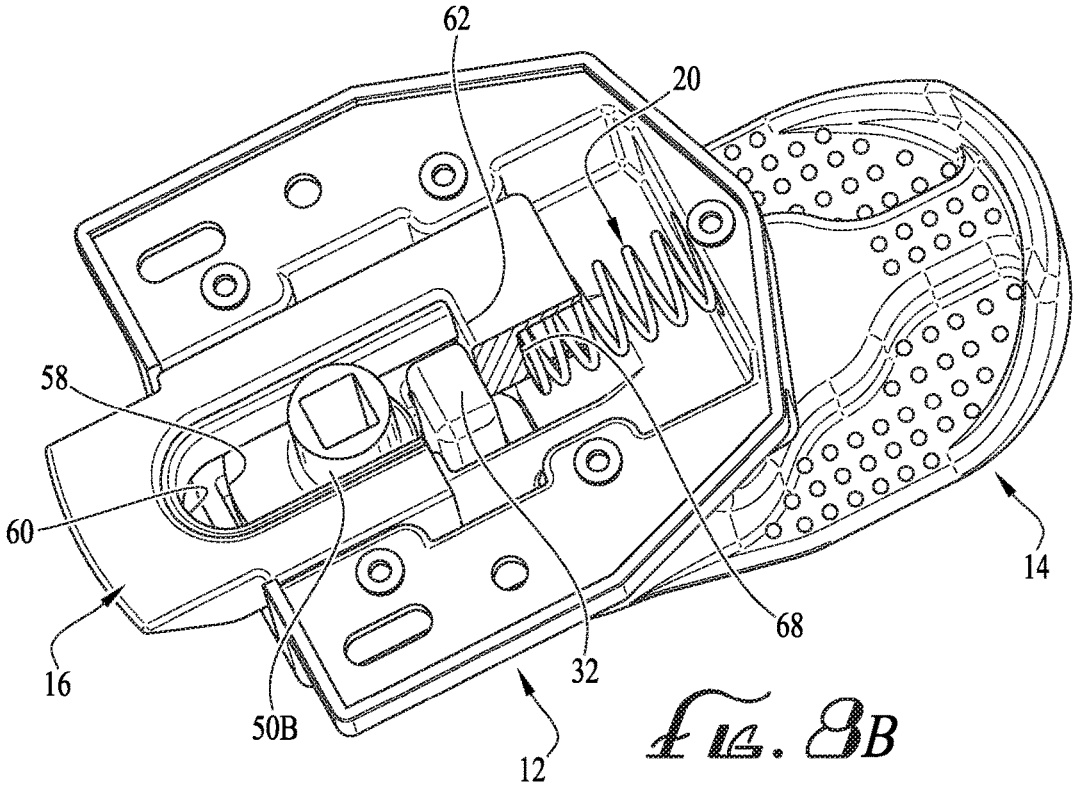
FIG. 8B is a front bottom perspective view of the expansion adjusting dual action door latch of FIG. 1 as assembled, with its bolt being partially cut away to reveal the cam and a lever arm of the handle, with the handle not lifted up and with the bolt fully extending out of the housing.

FIG. 8A is a front top perspective view of the expansion adjusting dual action door latch 10 of FIG. 1 as assembled, with its housing portion 12 being partially cut away to reveal the cam 18 and the bolt 16, with the handle 14 not lifted up and with the bolt 16 fully extending out of the housing 12, and FIG. 8B is a front bottom perspective view thereof, with its bolt 16 being partially cut away to reveal the cam 18 and the lever arm 32 of the handle 14. As can be seen, the upper boss portion 50A of the cam 18 is rotatably positioned in the well 76 of the housing 12, and the cam plate 52 rides on the top front surface 102 of the bolt 16. In this position, the backside of the lever arm 32 of the handle 14 will not be pushing on the proximal end 62 of the elongate recess 58 of the bolt 16 and therefore will not push the bolt 16 inwardly in the housing 12. Likewise, when the handle 14 is not lifted up, the coil spring 20 will be free to push the bolt 16 so that it extends fully out of the housing 12. When the cam 18 is not rotated, the cam 18 will likewise not impinge on the bolt 16 and draw it into the housing. In this position, the lower boss portion 50B is spaced a maximum distance from the distal end 60 of the elongate recess 58.

Figure 9A:
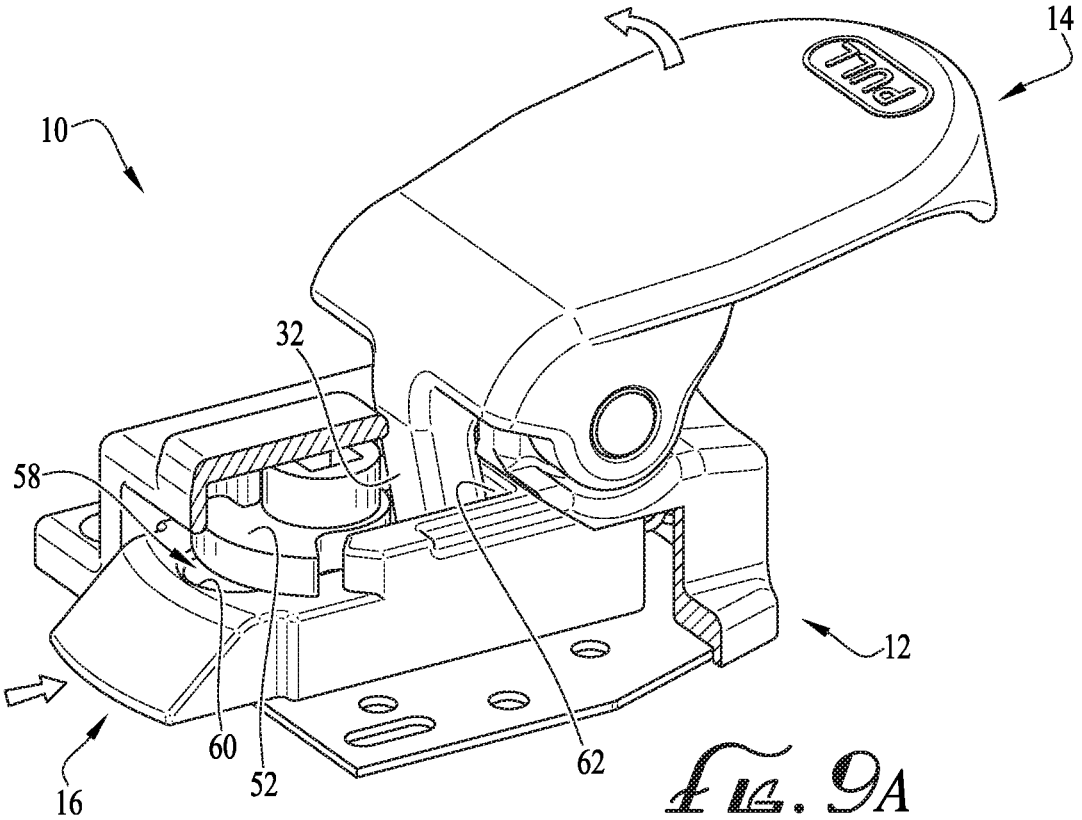
FIG. 9A is a front top perspective view of the expansion adjusting dual action door latch of FIG. 1 as assembled, with its housing being partially cut away to reveal the cam and the bolt, with the handle partially lifted up to start to withdraw the bolt into the housing.
Figure 9B:
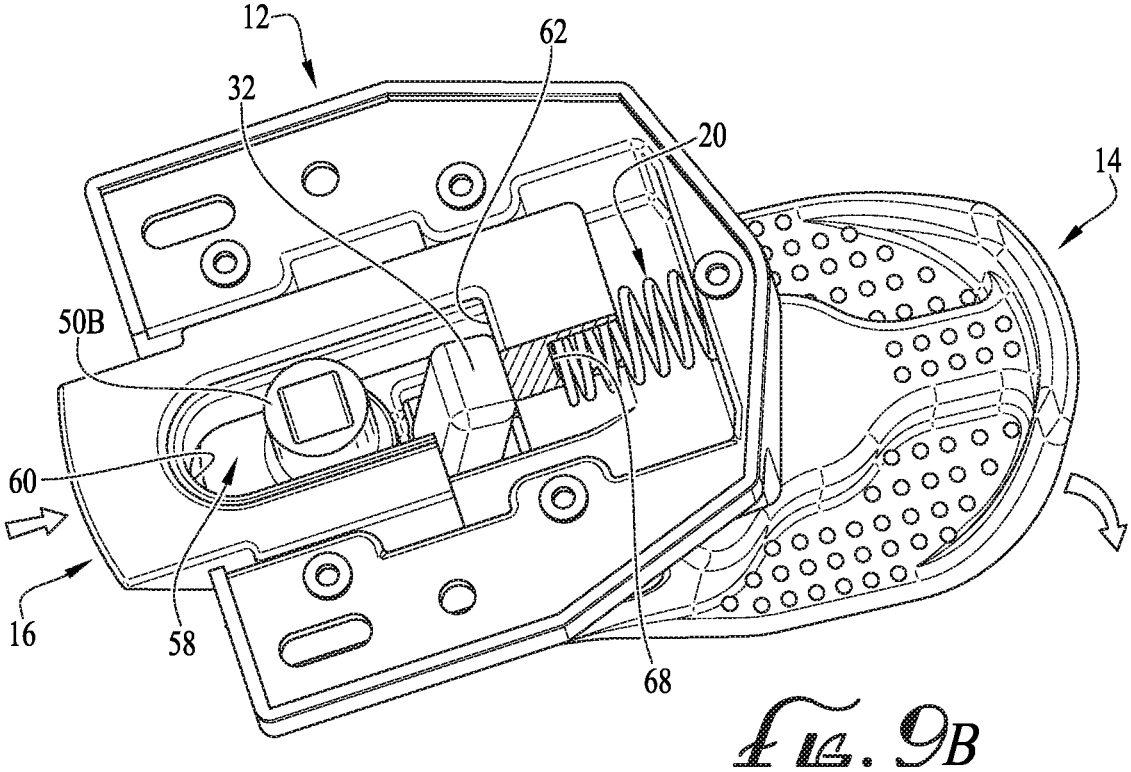
FIG. 9B a front bottom perspective view of the expansion adjusting dual action door latch of FIG. 1 as assembled, with its bolt being partially cut away to reveal the cam and the lever arm of the handle, with the handle partially lifted up to start to withdraw the bolt into the housing.

FIG. 9A is a front top perspective view of the expansion adjusting dual action door latch 10 of FIG. 1 as assembled, with its housing 12 being partially cut away to reveal the cam 18 and the bolt 16, with the handle 14 partially lifted up to start to withdraw the bolt 16 into the housing 12, and FIG. 9B a front bottom perspective view thereof, with its bolt 16 being partially cut away to reveal the cam 18 and the lever arm 32 of the handle 14, with its handle 14 partially lifted up so that the back side of the lever arm 32 will push against the proximal end 62 of the elongate recess 58 of the bolt 16 and start to push the bolt 16 inwardly in the housing 12. When the cam 18 is not rotated, the cam 18 continues not to impinge on the bolt 16 and draw it into the housing. In this position, the lower boss portion 50B is spaced an intermediate distance from the distal end 60 of the elongate recess 58.

Figure 10A:
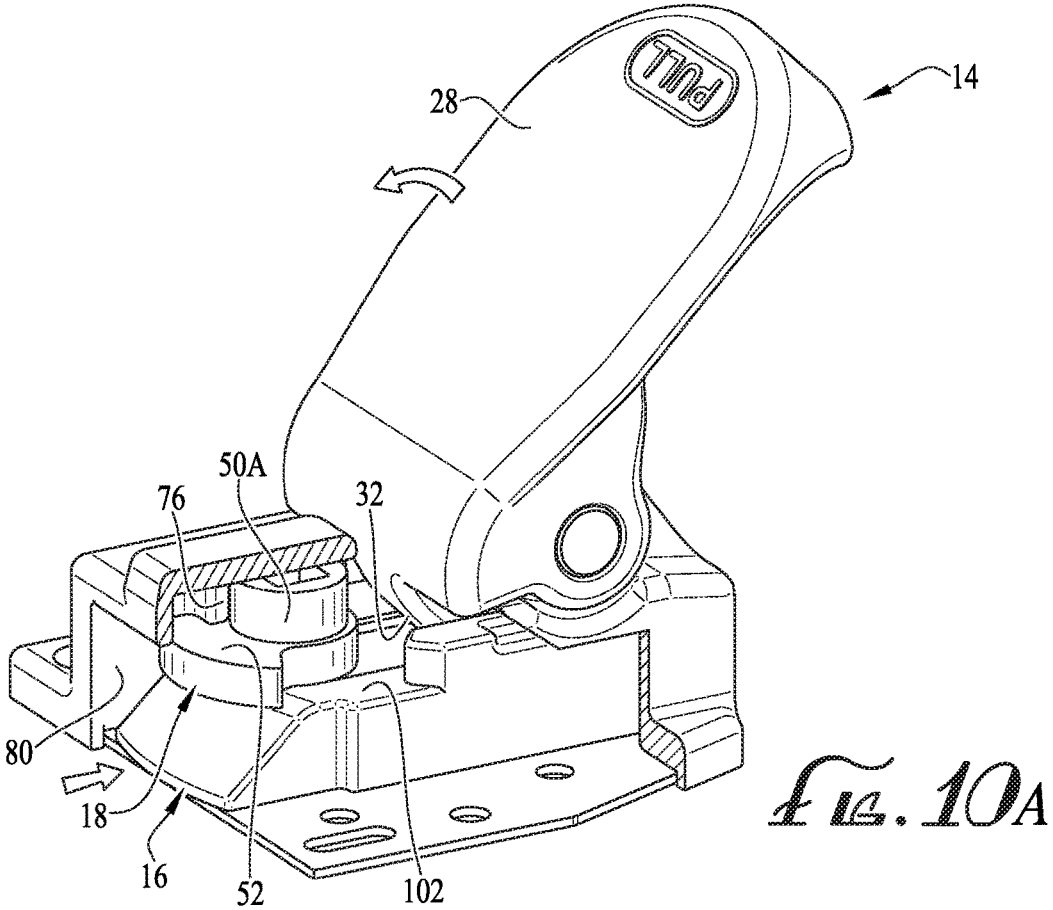
FIG. 10A is a front top perspective view of the expansion adjusting dual action door latch of FIG. 1 as assembled, with the housing being partially cut away to reveal the cam and the bolt, with the handle completely lifted up to fully withdraw the bolt into the housing.
Figure 10B:
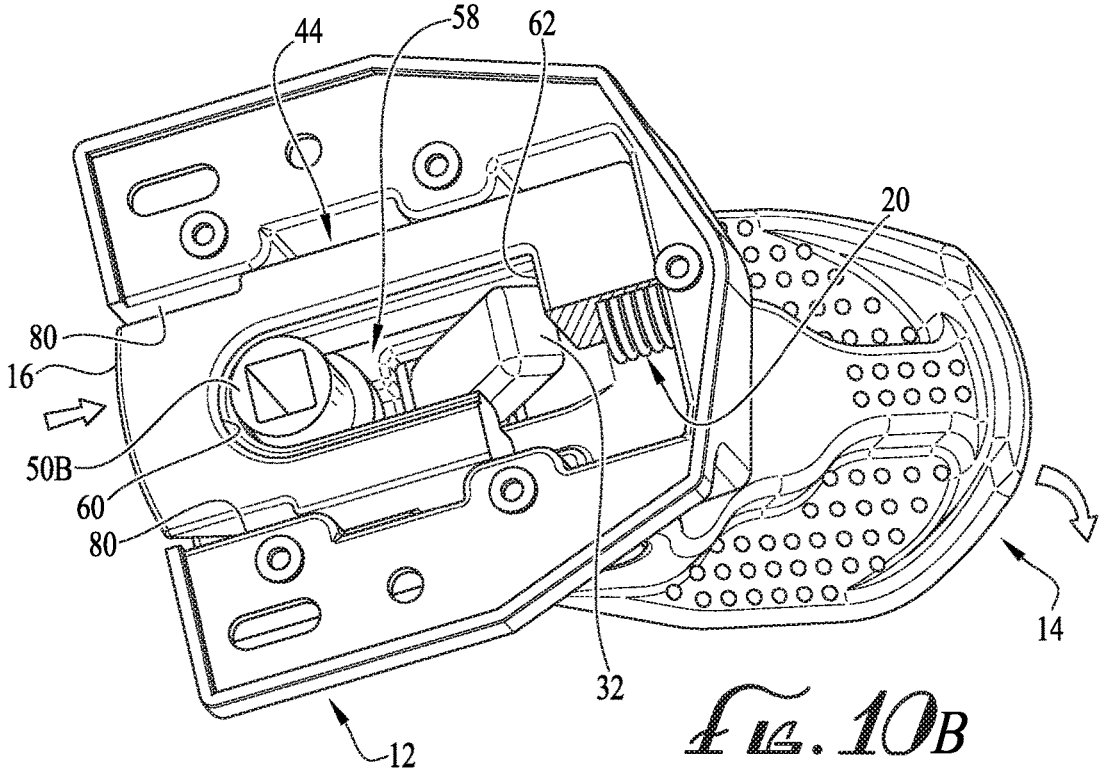
FIG. 10B a front bottom perspective view of the expansion adjusting dual action door latch of FIG. 1 as assembled, with its bolt being partially cut away to reveal the cam and the lever arm of the handle, with the handle completely lifted up to fully withdrawn the bolt into the housing.

FIG. 10A is a front top perspective view of the expansion adjusting dual action door latch 10 of FIG. 1 as assembled, with its housing 12 being partially cut away to reveal the cam 18 and the bolt 16, with its handle 14 completely lifted up to fully withdraw the bolt 16 into the housing 12, and FIG. 10B a front bottom perspective view thereof with its bolt 16 being partially cut away to reveal the cam 18 and the lever arm 32 of the handle 14, with its handle 14 fully lifted up so that the back side of the lever arm 32 pushes against the proximal end 62 of the elongate recess 58 of the bolt 16 to completely move the bolt 16 into the housing 12. When the cam 18 is not rotated, the cam 18 continues not to impinge on the bolt 16 and draw it into the housing. However, in this state of the handle, the lower boss portion 50B is now adjacent to the distal end 60 of the elongate recess 58, and the proximal end 56 of the bolt 16 will impinge on the closed end wall 82 of the bolt guide 44, which helps prevent it from moving inward any further. In the state, the coil spring 20 is compressed to its maximum. When the handle 14 is released, the bolt 16 will thus be pushed outwardly from the housing 12. Thus, in summary, FIGS. 9A-10B show how lifting up the handle 14 will withdraw the bolt 16 into the housing 12.

Figure 11A:
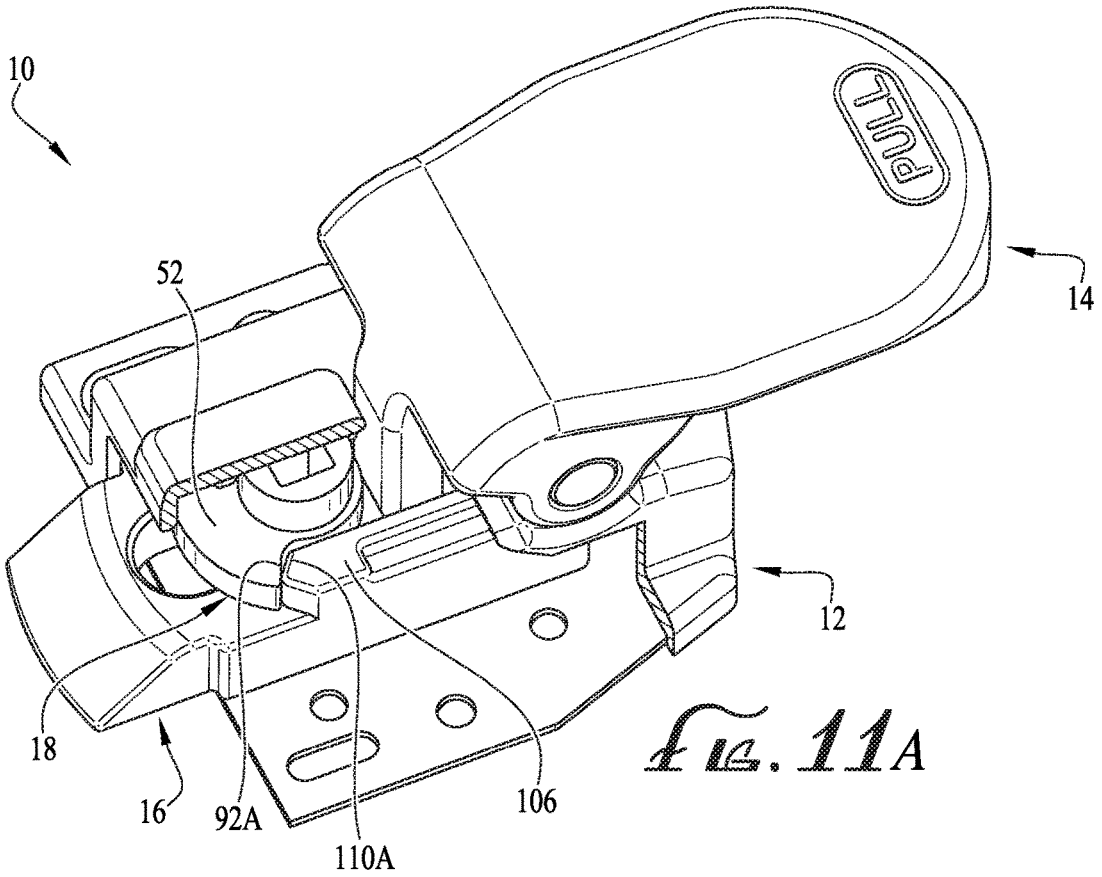
FIG. 11A is a front top right perspective view of the expansion adjusting dual action door latch of FIG. 1 as assembled, with the housing partially cut away to reveal the cam and the bolt, with the handle not lifted, the cam not turned, and the bolt fully extending out of the housing.
Figure 11B:
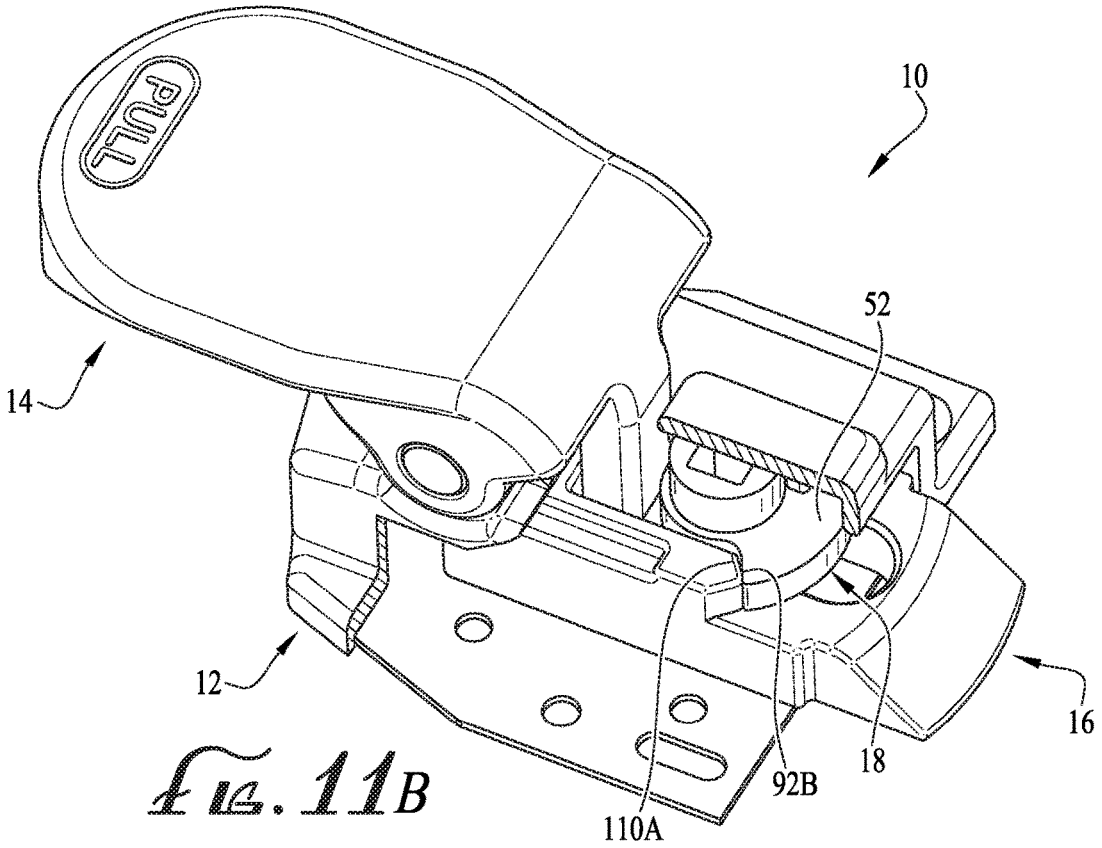
FIG. 11B is a front top left perspective view of the expansion adjusting dual action door latch of FIG. 1 as assembled, with the housing partially cut away to reveal the cam and bolt, with the handle not lifted, the cam not turned, and the bolt fully extending out of the housing.
Figure 11C:
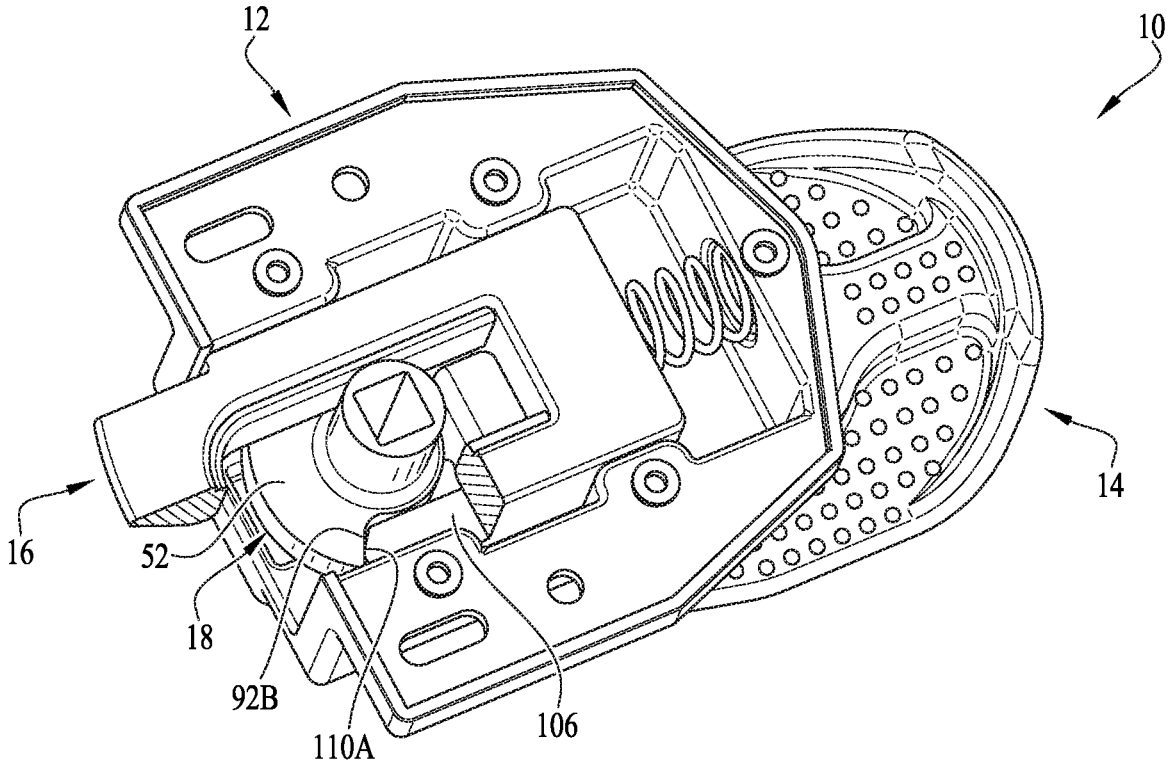
FIG. 11C is a front bottom perspective view of the expansion adjusting dual action door latch of FIG. 1 as assembled, with the bolt partially cut away to reveal the cam and its interaction with the bolt, with the handle not lifted, the cam not turned, and the bolt fully extending out of the housing.

FIG. 11A is a front top right perspective view, FIG. 11B is a front top left perspective view, and FIG. 11C is a front bottom perspective view of the expansion adjusting dual action door latch 10 of FIG. 1 as assembled, with its housing 12 partially cut away to reveal the cam 18 and the bolt 16, with the handle 14 not lifted, the cam 18 not turned, and the bolt 16 fully extending out of the housing 12. As can be seen, in this unturned position of the cam 18, the bolt 16 is fully extending out of the housing 12, and the cam 18 is positioned such that the two angled cutout ends 92A and 92B of the cam 18 resting against the inside edges 110A of the guide rails 106 of the bolt 16 but not exerting any pushing force on them to push the bolt 16 back into the housing 12.

Figure 12A:
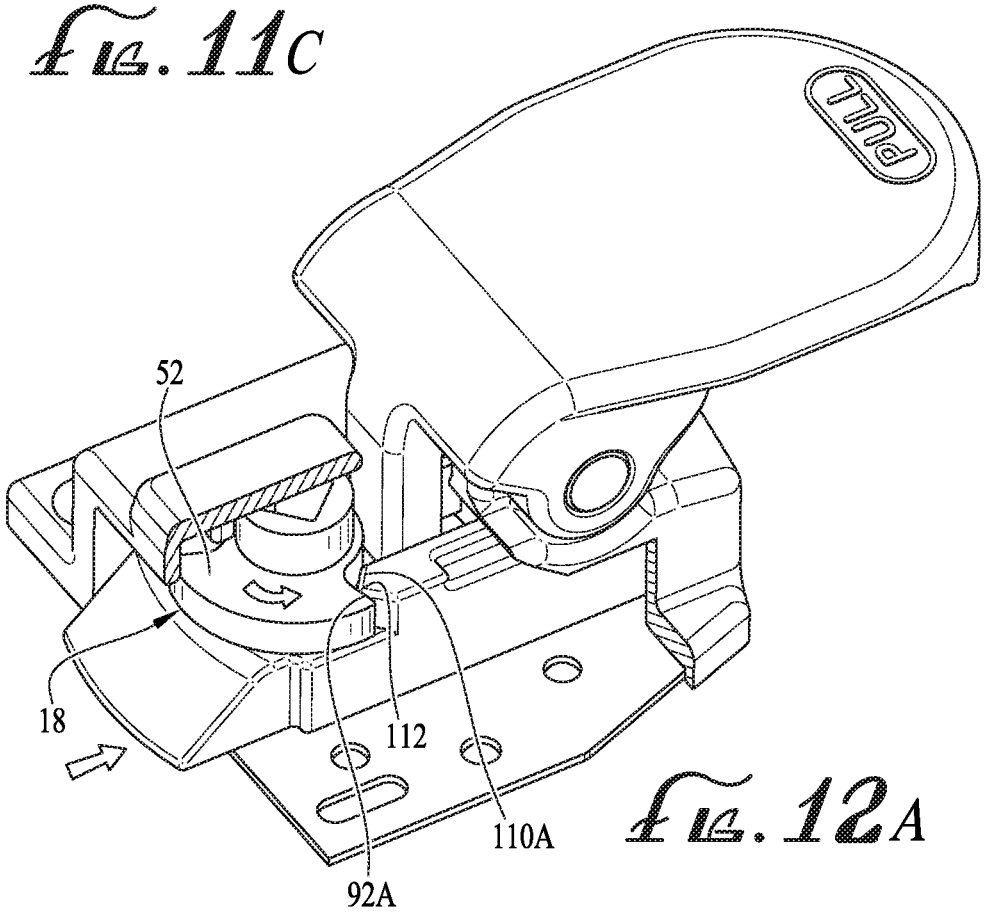
FIG. 12A is a front top right perspective view of the expansion adjusting dual action door latch of FIG. 1 as assembled, with the housing partially cut away to reveal the cam and bolt, with the handle not lifted, but with the cam partially turned and with the bolt partially withdrawn into the housing.
Figure 12B:
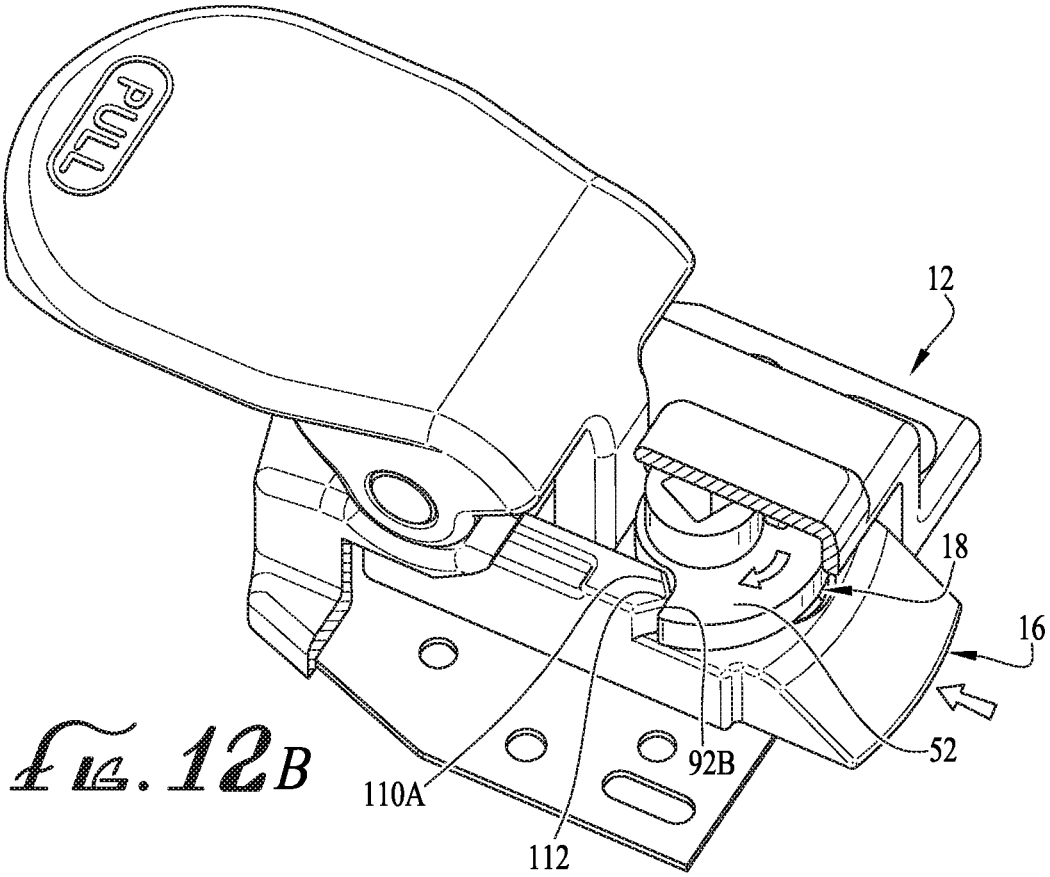
FIG. 12B is a front top left perspective view of the expansion adjusting dual action door latch of FIG. 1 as assembled, with the housing partially cut away to reveal the cam and bolt, with the handle not lifted, but with the cam partially turned and with the bolt partially withdrawn into the housing.
Figure 12C:
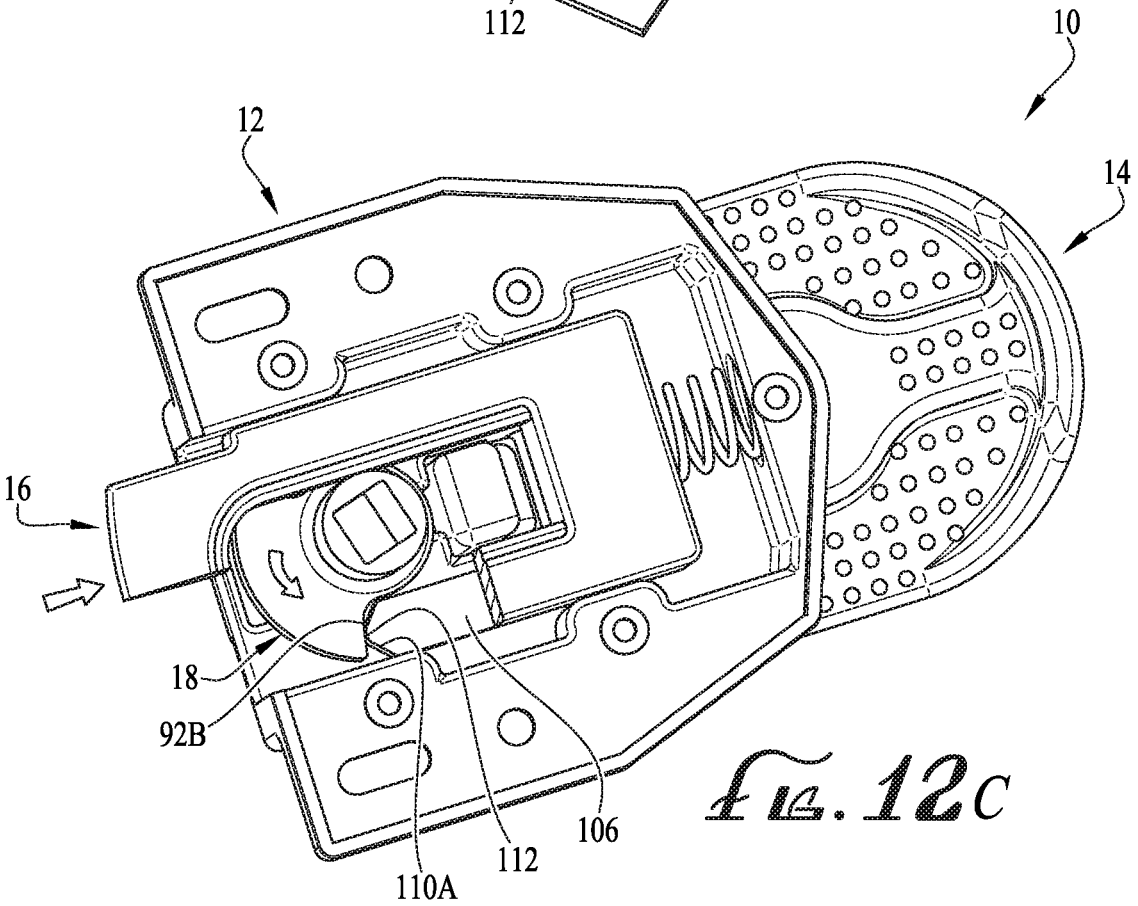
FIG. 12C is a front bottom perspective view of the expansion adjusting dual action door latch of FIG. 1 as assembled, with the bolt partially cut away to reveal the cam and its interaction with the bolt, with the handle not lifted, but with the cam partially turned and with the bolt partially withdrawn into the housing.

FIG. 12A is a front top right perspective view, FIG. 12B is a front top left perspective view, and FIG. 12C is a front bottom perspective view of the expansion adjusting dual action door latch 10 of FIG. 1 as assembled, with its housing 12 partially cut away to reveal the cam 18 and the bolt 16, with the handle 14 not lifted. In FIG. 12A, the cam 18 partially turned counterclockwise, and in FIGS. 12B and 12C, the cam 18 partially turned clockwise. By turning the cam either clockwise or counterclockwise, the result is the same as the bolt 16 partially withdrawn into the housing 12. When the cam 18 is partially turned counterclockwise, the angled cutout end 92A of the cam plate 52 will start to ride on and push back on the forward point 112 of the V-shaped distal end 108 of the guide rail 106 on the left side of the bolt 16 which starts to push the bolt back into housing. Likewise, when the cam 18 is partially turned clockwise, the other angled cutout end 92B of the cam plate 52 will start to ride on and push back on the forward point 112 of the V-shaped distal end 108 of the guide rail 106 on the right side of the bolt 16, which also starts to push the bolt back into housing. Thus, regardless of whether the cam is turned clockwise or counterclockwise, the bolts starts to move backwardly into the housing, independent of whether the handle 14 is lifted up.

Figure 13A:
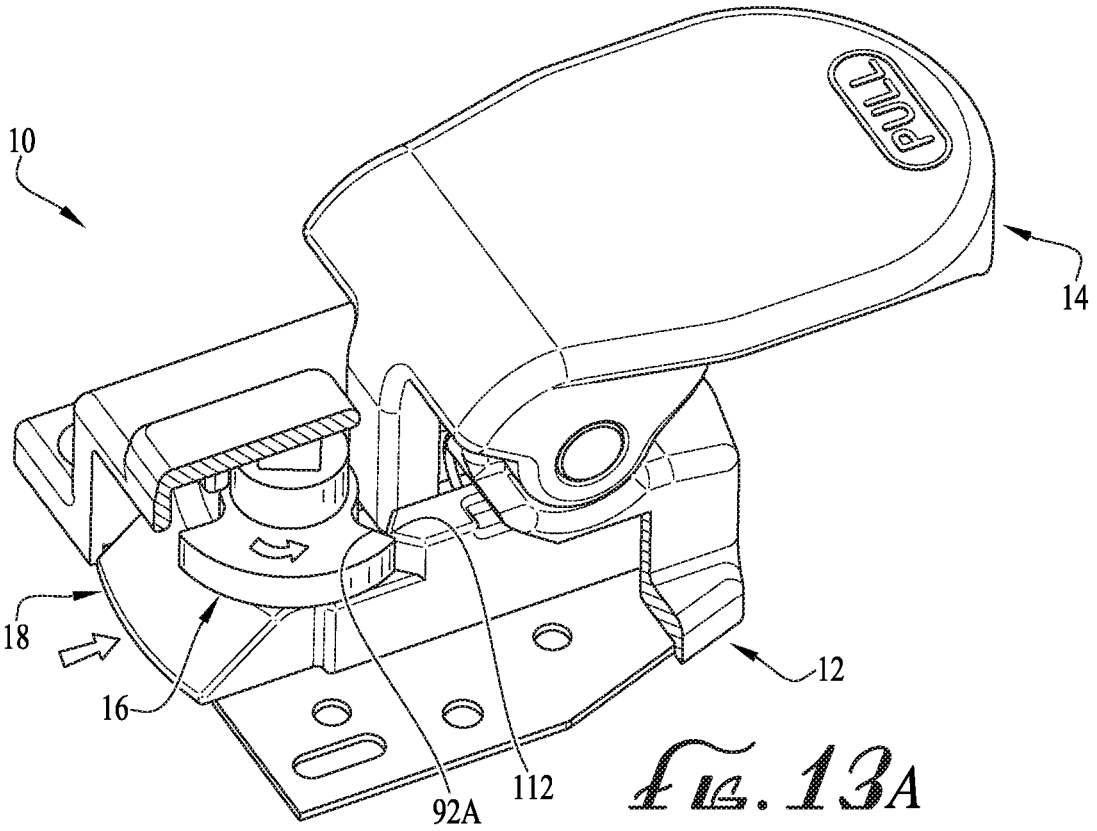
FIG. 13A is a front top right perspective view of the expansion adjusting dual action door latch of FIG. 1 as assembled, with the housing partially cut away to reveal the cam and bolt, with the handle not lifted, and with the cam completely turned counterclockwise to fully withdraw the bolt into the housing.
Figure 13B:
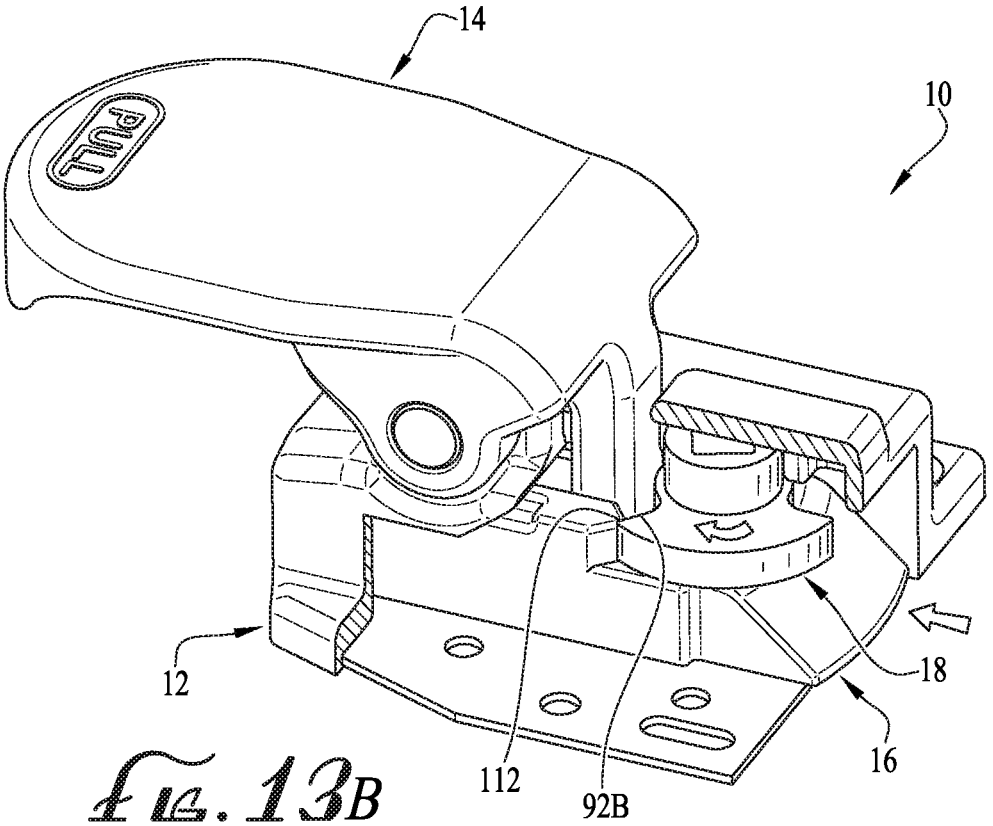
FIG. 13B is a front top left perspective view of the expansion adjusting dual action door latch of FIG. 1 as assembled, with the housing partially cut away to reveal the cam and bolt, with the handle not lifted, and with the cam completely turned clockwise to fully withdraw the bolt into the housing.
Figure 13C:
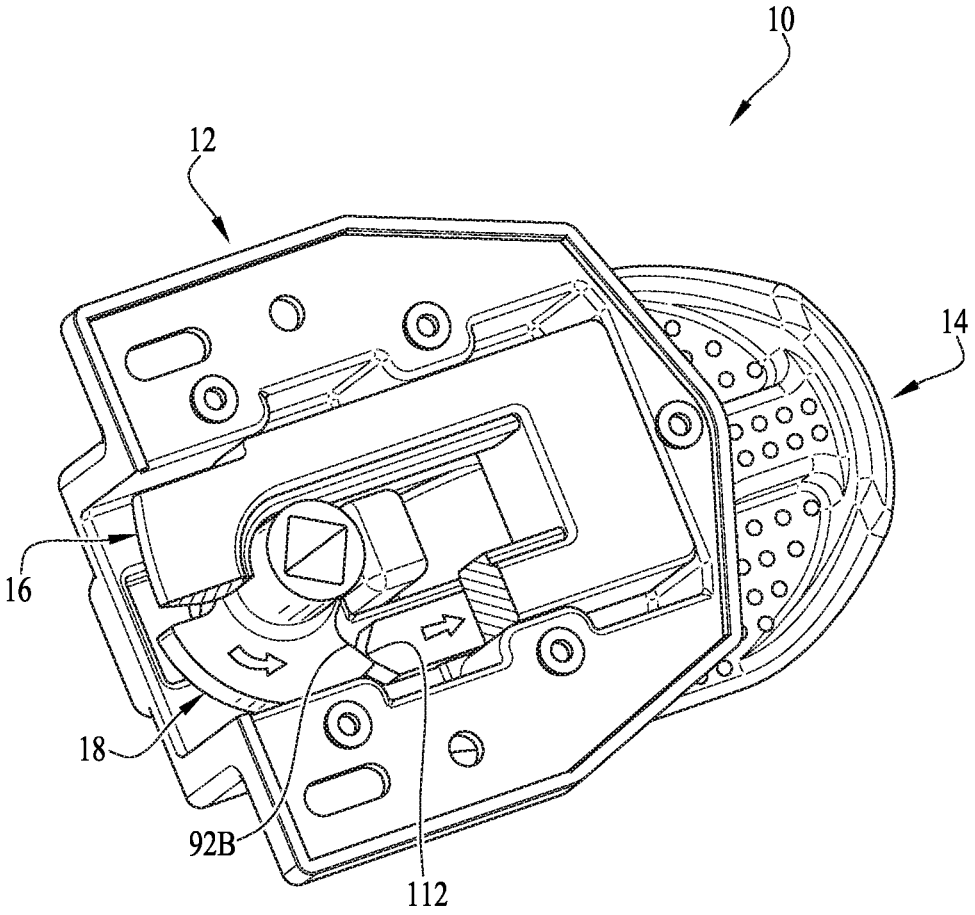
FIG. 13C is a front bottom perspective view of the expansion adjusting dual action door latch of FIG. 1 as assembled, with its bolt partially cut away to reveal the cam and its interaction, with the handle not lifted, and with the cam completely turned clockwise to fully withdraw the bolt into the housing.

FIG. 13A is a front top right perspective view, FIG. 13B is a front top left perspective view, and FIG. 13C is a front bottom perspective view of the expansion adjusting dual action door latch 10 of FIG. 1 as assembled, with its housing 12 partially cut away to reveal the cam 18 and the bolt 16, with the handle 14 not lifted. In FIG. 13A, the cam 18 turned counterclockwise as far as possible until the bolt 16 moves fully into the housing, and in FIGS. 13B and 13C, the cam 18 partially turned clockwise until the bolt 16 moves fully into the housing. By turning the cam either clockwise or counterclockwise, the result is the same as the bolt 16 is fully withdrawn into the housing 12. When the cam 18 is turned counterclockwise, the angled cutout end 92A of the cam plate 52 will be fully riding on and push back on the forward point 112 of the V-shaped distal end 108 of the guide rail 106 on the left side of the bolt 16 which completes it push to push the bolt back into housing. Likewise, when the cam 18 is partially turned clockwise, the other angled cutout end 92B of the cam plate 52 will ride on and fully push back on the forward point 112 of the V-shaped distal end 108 of the guide rail 106 on the right side of the bolt 16, which also pushes the bolt 16 completely into housing. Thus, regardless of whether the cam is turned clockwise or counterclockwise, the bolt 16 will be fully moved backwards into the housing, independent of whether the handle 14 is lifted up.

Figure 14A:
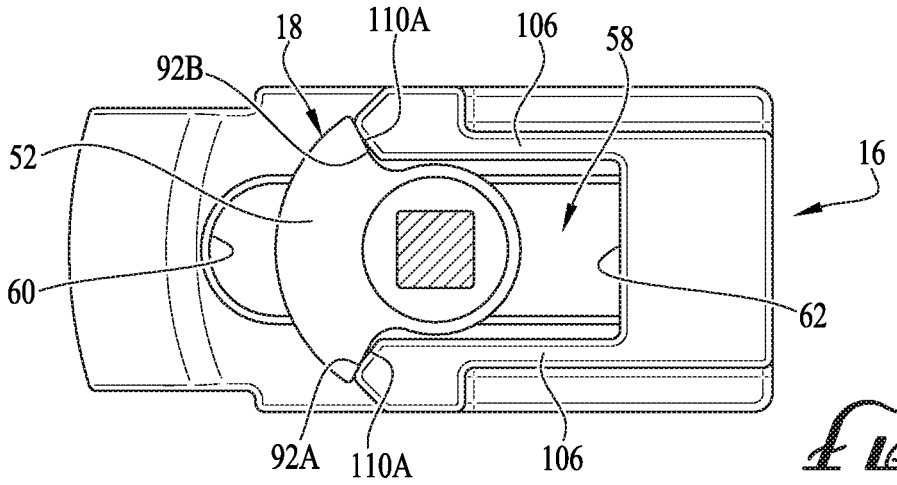
FIG. 14A is top view showing the cam engaged with the bolt with the cam in its unturned position.

FIG. 14A is top view showing just the cam 18 and the bolt 16 in isolation, with the cam portion 18 in its unturned position where the angled cutout ends 92A and 92B of the cam plate 52 both seat on both of the inside surfaces 110A of the two opposite guide rails 106 of the bolt 16 but do not exert any pushing force on the guide rails 106 such as to push the bolt 16 rearwardly away from the cam 18. In this state, the cam 18 is moved as far to the right as it may. This view corresponds to states of the cam 18 and the bolt 16 in the housing 12 of FIGS. 11A-C.

Figure 14B:
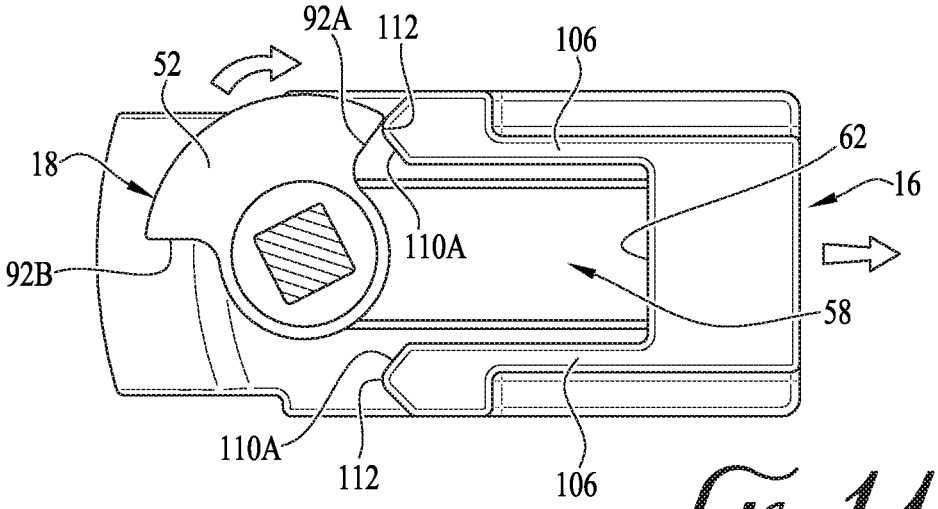
FIG. 14B is top view showing the cam engaged with the bolt with the cam fully turned to its clockwise position.

FIG. 14B is top view showing the cam 18 engaged with the bolt 16 with the cam 18 fully turned to a clockwise position, where the angled cutout end 92A of the cam plate 52 will unseat from the inside surfaces 110A of the right guide rail 106 of the bolt 16 and ride on the forward point 112 of the V-shaped distal end 108 of the guide rail 106 and move the bolt 16 rearwardly, and the opposite angled cutout end 92B of the cam plate 52 will totally displace from the left side guide rail 106 of the bolt 16. In this state, the cam 18 is moved as far to the left away from the proximal end 62 of the elongate recess 58 formed in the bolt 16 as possible since its lower boss 50B (not shown) will be impinging on the distal end 60 of the elongate recess 58. This view corresponds to states of the cam 18 and the bolt 16 in the housing 12 of FIG. 13B.

Figure 14C:
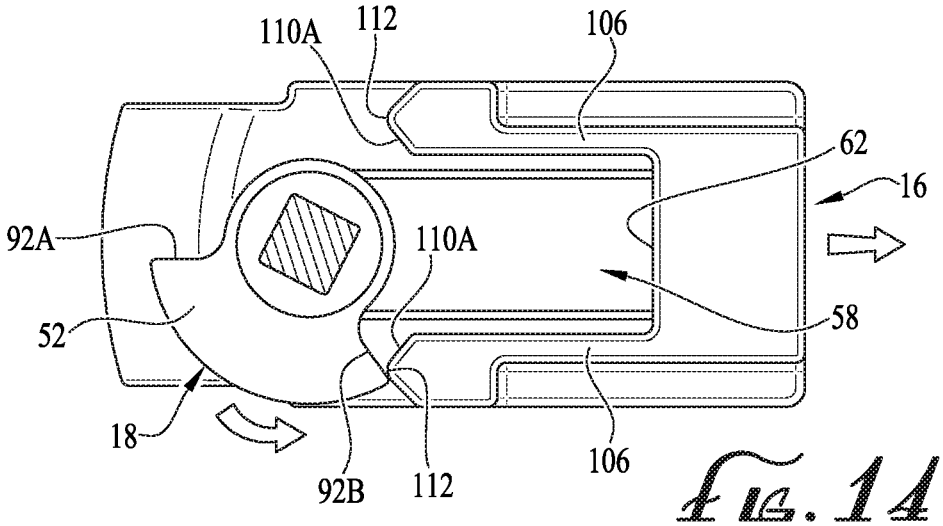
FIG. 14C is top view showing the cam engaged with the bolt with the cam fully turned to its counterclockwise position.

FIG. 14C is a top view showing the cam 18 engaged with the bolt 16 with the cam 18 fully turned to a counterclockwise position, where the angled cutout end 92B of the cam plate 52 will unseat from the inside surfaces 110A of the left guide rail 106 of the bolt 16 and ride on the forward point 112 of the V-shaped distal end 108 of the guide rail 106 and move the bolt 16 rearwardly, and the opposite angled cutout end 92A of the cam plate 52 will totally displace from the right side guide rail 106 of the bolt 16. In this state, the cam 18 is also moved as far to the left away from the proximal end 62 of the elongate recess 58 formed in the bolt 16 as possible, since its lower boss 50B (not shown) will be impinging on the distal end 60 of the elongate recess 58. This view corresponds to states of the cam 18 and the bolt 16 in the housing 12 of FIGS. 13A and 13C.

Figure 15B:
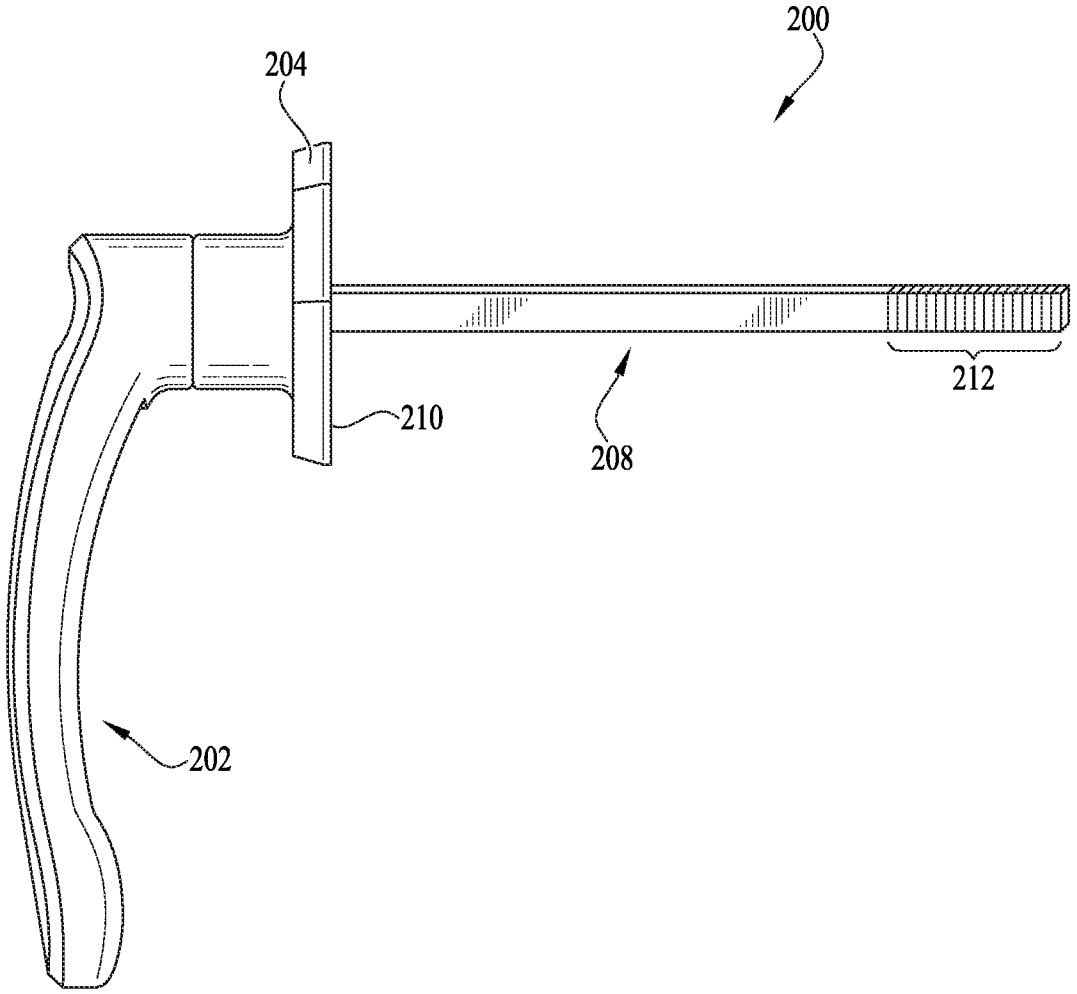
FIG. 15B (PRIOR ART)
FIG. 15B is a side view of the exemplary prior art turning handle of FIG. 15A.
Figure 15A:
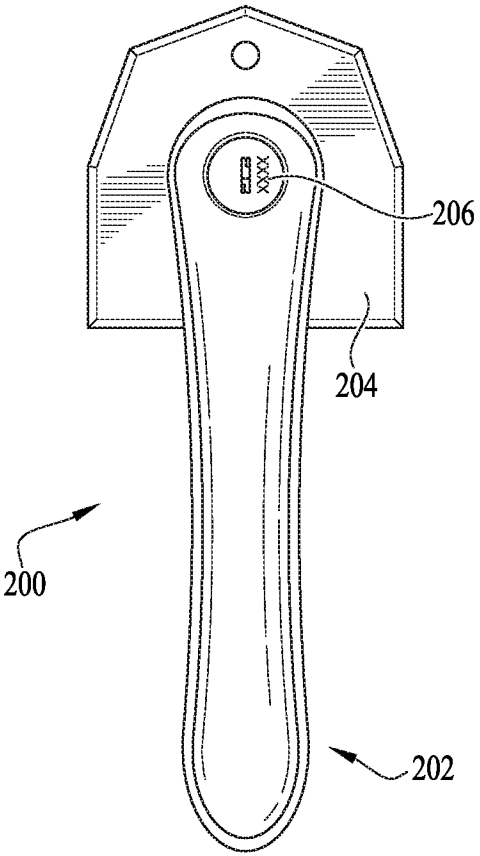
FIG. 15A (PRIOR ART)
FIG. 15A is a front view of an exemplary prior art turning handle used with the expansion adjusting dual action door latch of FIG. 1.
Figure 16:
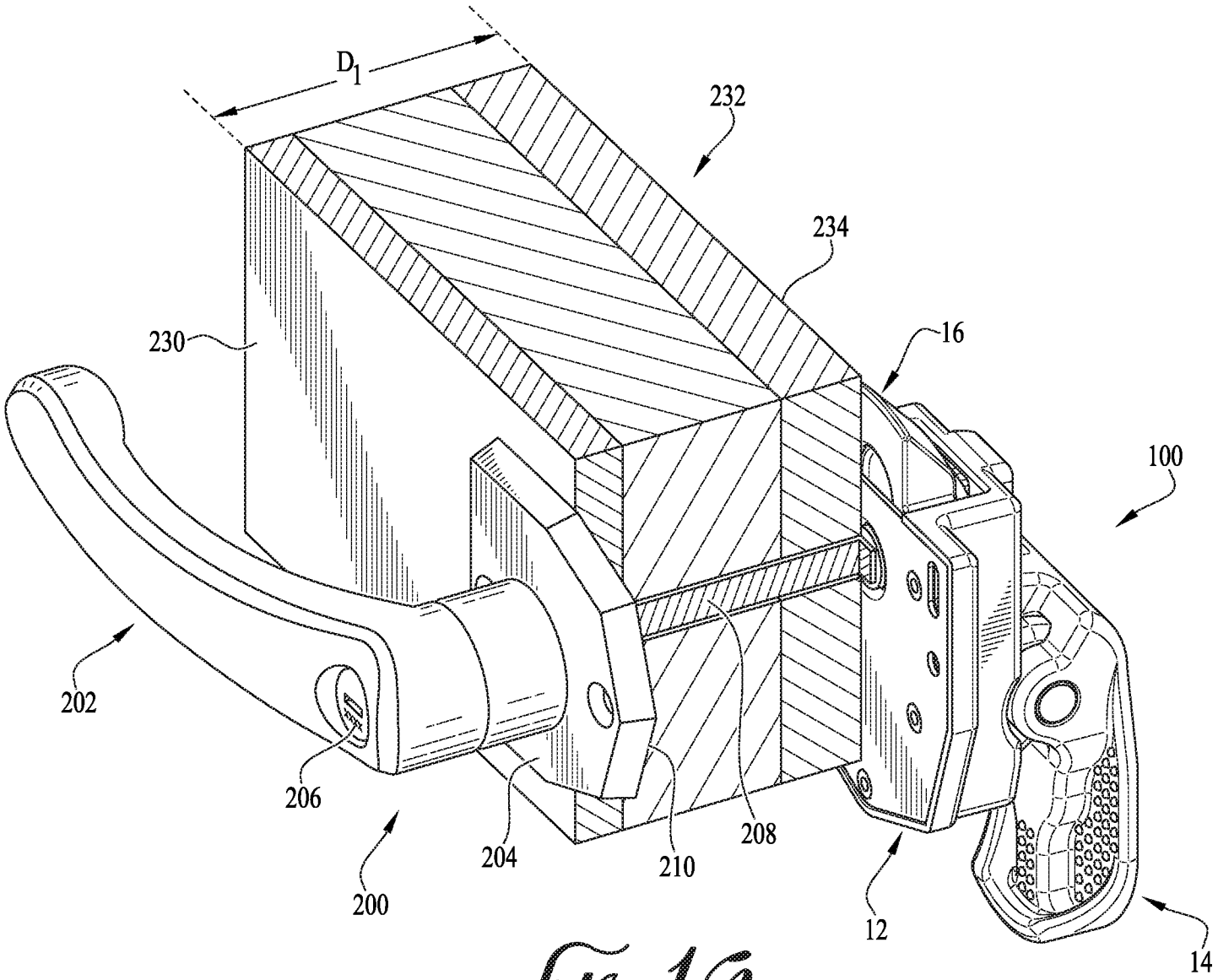
FIG. 16 is a partially exposed perspective cross-sectional exposed view of a door with the exemplary prior art turning handle of FIG. 15A on one side of the door and connected to the expansion adjusting dual action door latch of FIG. 1 on the other side of the door, with the door having a smaller thickness $D_1$.
Figure 17A:
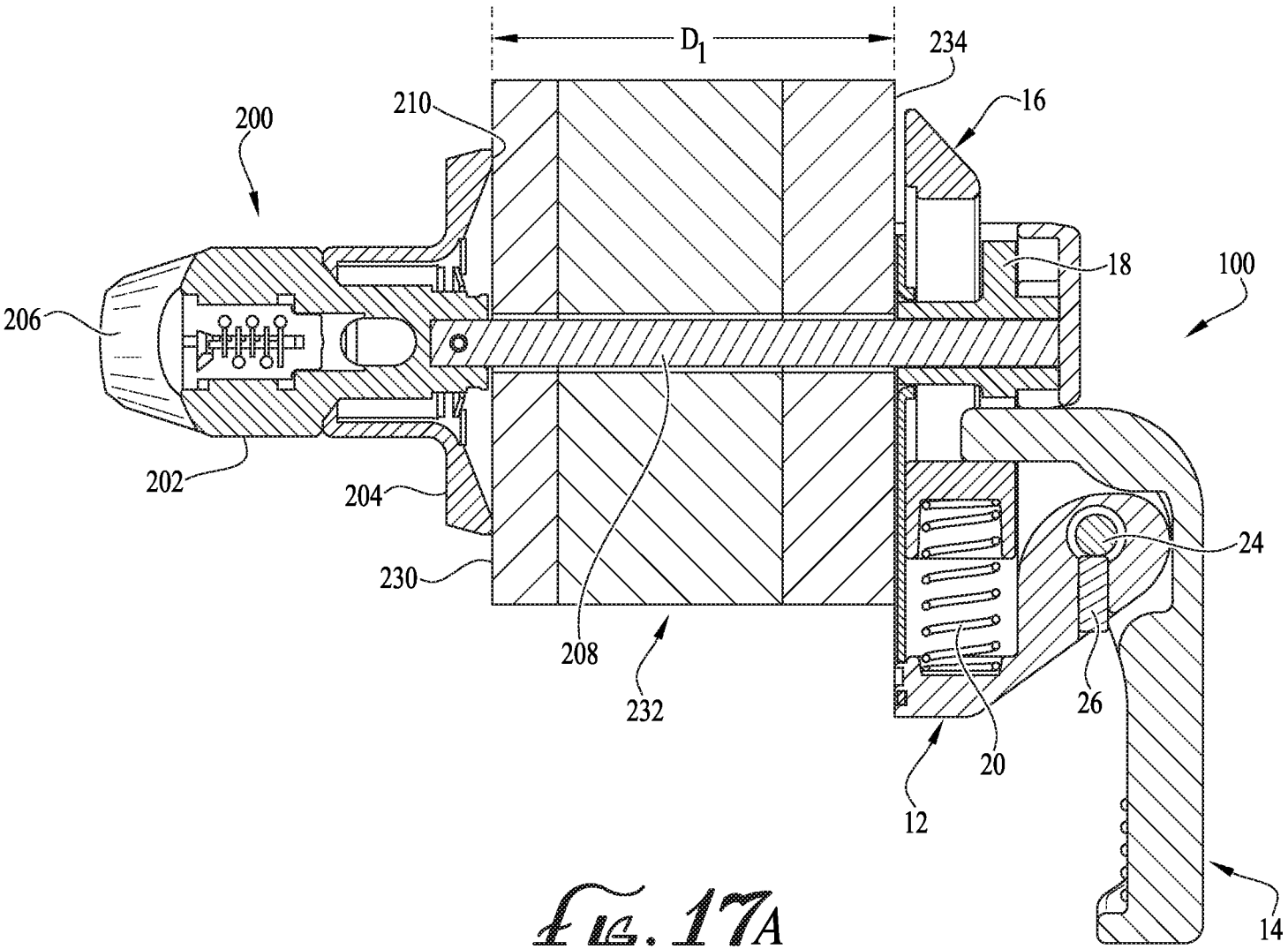
FIG. 17A is a cross sectional side view of the door with the exemplary prior art turning handle of FIG. 15B on one side of the door and connected to the expansion adjusting dual action door latch of FIG. 1 on the other side of the door, with the door having a smaller thickness $D_1$.
Figure 17B:
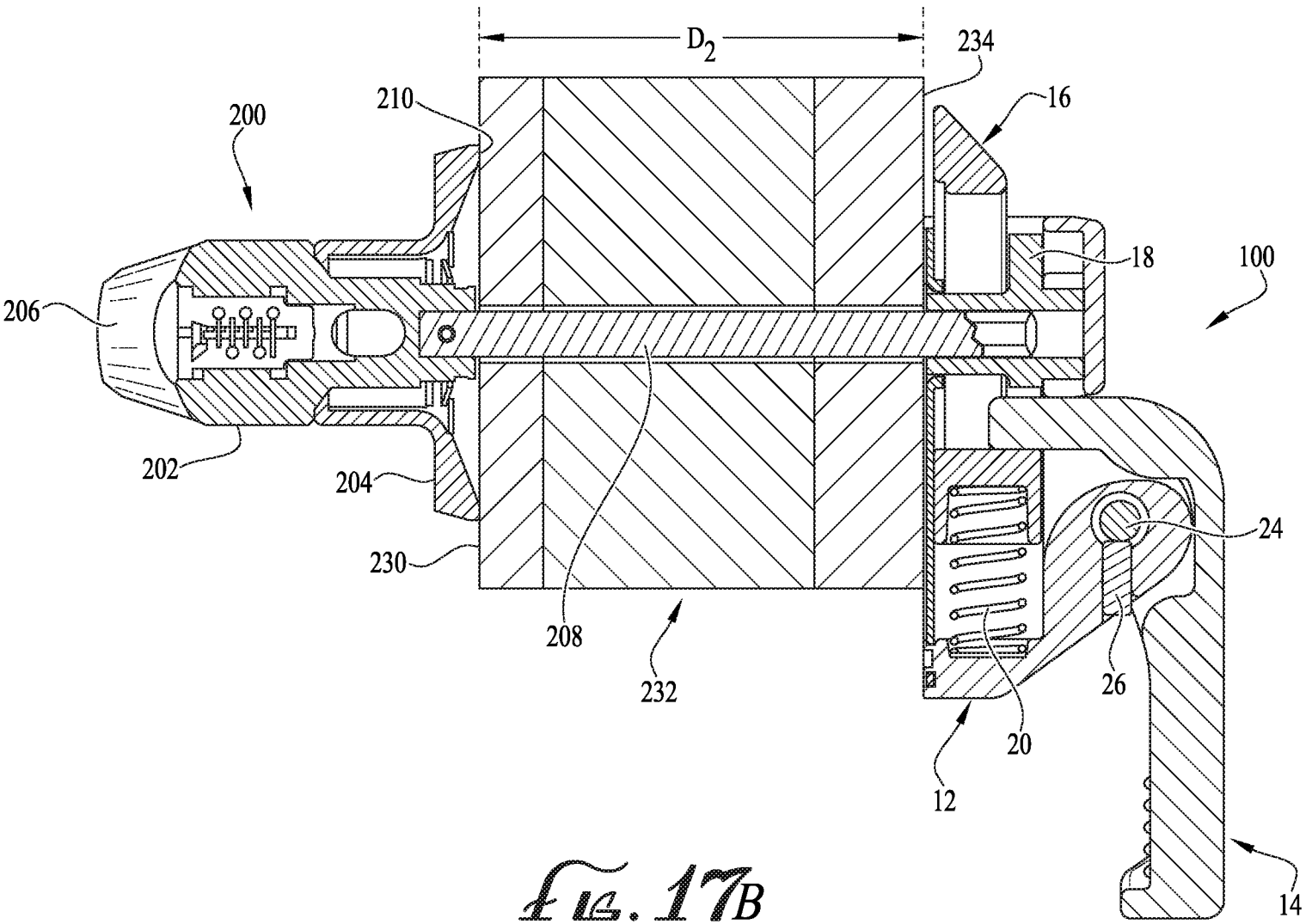
FIG. 17B is a cross sectional side view of the door with the exemplary prior art turning handle of FIG. 15B on one side of the door and connected to the expansion adjusting dual action door latch of FIG. 1 on the other side of the door, with the door having an expanded thickness $D_+$.

FIG. 15A is a front view and FIG. 15B is a side view of an exemplary prior art turning handle 200 used with the expansion adjusting dual action door latch 10 of the invention. The turning handle 200 may include a handle portion 202 and an escutcheon 204. The turning handle 200 may include a lock 206. An elongate turning shaft 208 extends away from a back 210 of the escutcheon 204. At a distal end of the turning shaft 208 there is cam engagement end 212. The cam engagement end 212 is keyed to freely slidably engage with the passageway 96 of the boss portion 50 of the cam 18, as shown in FIGS. 16 and 17A and 17B. In the exemplary embodiment shown, the cam engagement end 212 has a square cross-section to key with the exemplary square passageway 96 in the boss 50 of the cam 18. However, other non-round shapes can be employed so long as the fit is not too tight as to interfere with the free longitudinal movement of the cam engagement end 212 relative to the cam 18.

FIG. 16 is a partially exposed perspective cross-sectional view of a door 232 with the exemplary prior art turning handle 200 of FIG. 15A on a first side 230 of the door 232 and connected to the expansion adjusting dual action door latch 10 of the invention on the opposite side 234 of the door 232, when the door 232 has a first smaller, unswelled thickness $D_1$. This would generally correspond to a first initial installation of the expansion adjusting dual action door latch 10 and prior art turning handle 200 where the door 232 is new and has not weathered and possibly swelled in thickness.

FIG. 17A is a cross sectional side view of the door with the exemplary prior art turning handle 200 of FIG. 15B on the first side 230 of the door 232 and connected to the expansion adjusting dual action door latch 10 on the other side 234 of the door 232, again where the door 232 has the first smaller, unswelled thickness $D_1$. As can be seen, at this initial thickness $D_1$ of the door 232, the distal end 212 of the shaft 208 of the turning handle 200 will be fully slid into the passageway 96 in the boss 50 of the cam 18. Turning the handle portion 202 of the turning handle 200 either clockwise or counterclockwise will thus turn the cam 18 and cause the bolt 16 to be withdrawn into the housing 12 and thereby unlock the expansion adjusting dual action door latch 10 of the invention.

As has been noted above, doors 232 are often made from materials such as plywood, particle board, and waferboard. When such materials get soaked with water, particularly on a recurring basis, this can cause swelling of the thickness of the door 232 from an initial smaller thickness $D_1$ and a second larger thickness $D_2$, as shown in FIG. 17B. If this occurs, and there is not some built in degree of freedom of movement in the connection between the turning handle 200 and the expansion adjusting dual action door latch 10, then this swelling can cause binding up of one or both of the turning handle 200 and the expansion adjusting dual action door latch 10, either of which can interfere with their operations. The expansion adjusting dual action door latch 10 of the invention solves this issue by allowing a turning shaft of the cam 18 to laterally slidably engage though the passageway 96 in the boss 50 of the cam 18 to accommodate any expansion in the thickness of the door 232 from a first smaller, unswelled thickness $D_1$ to a larger, swelled thickness $D_2$, where the difference equals $D_2-D_1$. Thus, operation of the door from either side will not be impacted. In the swelled thickness door 232 of FIG. 17B, the square cross-sectional end 212 will partially retract from the passageway 96 in the boss 50 of the cam 18 by a distance of $D_2-D_1$ to accommodate the same thickness change of $D_2-D_1$ in the door 232 as it swells.

While one chief purpose of the expansion adjusting dual action door latch 10 of the invention is to accommodate possible door swelling, this same feature allows a given turning handle 200 and expansion adjusting dual action door latch 10 to be fit to a wide range of door thickness when new, without having to make other adjustment or swap out parts. For example, in an exemplary embodiment of the expansion adjusting dual action door latch 10, the boss 50 is about 1" (2.5 cm) long, and so long as at least about ¼" (0.6 cm) of the distal end 212 of the shaft 208 of the turning handle 200 remains in the passageway 96 in the boss 50 of the cam 18, the cam 18 of the expansion adjusting dual action door latch 10 can be operated by the turning handle 200.

Again, advantages of the expansion adjusting dual action door latch 10 include a new internal design, which when coupled with the shaft 208 of the turning handle 200 accommodates door swell with no risk of binding interfaces. This leads to improved ergonomics and ease of operator opening from either side of the door 232. Typically the expansion adjusting dual action door latch 10 will be located to be the inside handle, which will be operated by an easy pull action release versus a turning operation, and the outside turning handle 200 will operate with a standard turning action.

The expansion adjusting dual action door latch 10 leads to a more efficient installation process, compared for example, to designs like under U.S. Pat. No. 8,449,003 that utilizes an internal portion of spring loaded door expansion adjusting set. This saves on installation time as installers are only required to secure the expansion adjusting dual action door latch 10 with, for example, four screws through four mounting holes 38 in the housing 12 and with no adjustment of spring compression being required. This in turn eliminates any risk of stripping or damaging the lock due to improper expansion set adjustment.

The preferred embodiments of this invention have been disclosed, however, so that one of ordinary skill in the art would recognize that certain modifications would come within the scope of this invention.

What is claimed is:

1. A dual action latch for mounting to the outside of a door, comprising:

a latch handle comprising a lever arm;

an elongate bolt comprising a distal end and a proximal end, and an elongate recess formed therein, the recess having a proximal end and a distal end;

a single cam comprising a boss and consisting of a single cam plate, wherein at least a portion of the boss is sized to movably pass through the elongate recess of the elongate bolt wherein the single cam is a part separate from the elongate bolt;

a self-contained latch housing for mounting to the outside of a door comprising a lever arm aperture through which the lever arm of the latch handle passes, a bolt guide for slidably receiving the elongate bolt, the latch handle being movably attached to the latch housing, and the bolt guide being open at one end to permit the distal end of the elongate bolt to extend out of the latch housing; and a biasing device which biases the elongate bolt such that its distal end extends out of the open end of the latch housing, wherein when the single cam is rotated both in a clockwise and a counterclockwise direction, the cam plate directly impinges on the elongate bolt and withdraws the elongate bolt into the latch housing, and wherein when the latch handle is moved the lever arm impinges on the proximal end of the recess of the elongate bolt and withdraws the elongate bolt into the self-contained latch housing.

2. The dual action latch of claim 1, wherein the biasing device comprises a spring positioned in the latch housing interposed between the proximal end of the elongate bolt and a closed end of the bolt guide opposite the open end of the bolt guide.

3. The dual action latch of claim 1, wherein the boss of the single cam includes an upper boss portion positioned above the single cam plate and a lower boss portion below the single cam plate, wherein the upper boss portion is rotatably received in a cam engagement formed in the self-contained latch housing, and wherein the lower boss portion freely passes though the elongate recess of the elongate bolt.

4. The dual action latch of claim 1, wherein the elongate bolt further comprises two guide rails that are positioned along both elongate sides of the elongate recess, each guide rail having a distal end, wherein the single cam plate has two engaging surfaces, and wherein when the cam is rotated in both a clockwise and a counterclockwise direction, one of the two engaging surfaces will impinge on the distal end of one of the two guide rails.

5. The dual action latch of claim 1, wherein the boss of the cam further consists of a shaft engagement for rotating the cam.

6. The dual action latch of claim 5, further comprising a housing closure on a bottom of the self-contained latch housing, which housing closure has an aperture that is aligned with the shaft engagement to permit external access to rotate the single cam.

7. The dual action latch of claim 5, further comprising a cam rotating shaft, which cam rotating shaft is laterally slidably engageable with the shaft engagement of the single cam.

8. The dual action latch of claim 7, further comprising a secondary latch handle adapted for rotating the cam rotating shaft and turning the single cam, which secondary latch handle and the dual action latch are displaceable relative to each other without disengaging the shaft from the single cam.

9. The dual action latch of claim 1, further comprising a pivot pin that pivotally connects the latch handle to the self-contained latch housing.

10. The dual action latch of claim 1, wherein the latch handle further comprises a lifting grip portion.

11. A dual action latch for mounting to the outside of a door, comprising:

a movable latch handle comprising a lever arm;

an elongate bolt;

a single cam comprising a boss and a consisting of a single a cam plate, wherein the single cam is a part separate from the elongate bolt;

a latch housing for mounting to the outside of a door to which the latch handled is movably engaged, the latch housing comprising a lever arm aperture through which the lever arm passes, and a bolt guide for slidably receiving the elongate bolt, wherein the latch housing is open at one end to permit a distal end of the elongate bolt to extend outside of the latch housing; and a biasing device which biases the elongate bolt out of the open end of the latch housing, wherein when the single cam is rotated both in a clockwise and a counterclockwise direction, the single cam plate directly impinges on the elongate bolt and withdraws the elongate bolt into the latch housing, and wherein when the movable latch handle is moved the lever arm directly impinges on the elongate bolt and withdraws the elongate bolt into the self-contained latch housing.

12. The dual action latch of claim 11, wherein the biasing device comprises a spring positioned in the self-contained latch housing interposed between the proximal end of the elongate bolt and a closed end of the bolt guide opposite the open end of the bolt guide.

13. The dual action latch of claim 11, wherein the single cam further comprises an upper boss portion positioned above the single cam plate and a lower boss portion below the single cam plate, wherein the upper boss portion is rotatably received in a cam engagement formed in the latch housing, and wherein the lower boss portion movably passes through an elongate recess in the elongate bolt.

14. The dual action latch of claim 11, wherein the elongate bolt further comprises two guide rails that are positioned along both sides of an elongate recess formed therein and having a distal end, wherein the single cam plate has two engaging surfaces, and wherein when the single cam is rotated in both a clockwise and a counterclockwise direction, one of the two engaging surfaces will impinge on the distal end of one of the two guide rails and push the elongate bolt into the latch housing.

15. The dual action latch of claim 11, wherein the elongate bolt further comprises an elongate recess formed therein and having a proximal end, and wherein when the movable latch handle is moved, the lever arm impinges on the proximal end of the recess of the elongate bolt and moves the elongate bolt into the self-contained latch housing.

16. The dual action latch of claim 11, wherein the single cam further comprises a boss with a shaft engagement, which shaft engagement is adapted for turning the single cam from outside of the self-contained latch housing.

17. The dual action latch of claim 16, further comprising a housing closure on a bottom of the self-contained latch housing, which housing closure has an aperture that is aligned with the shaft engagement to permit external access to rotate the single cam.

18. The dual action latch of claim 16, further comprising a cam rotating shaft, which cam rotating shaft is laterally slidably engageable with the shaft engagement adapter of the single cam.

19. The dual action latch of claim 18, further comprising a secondary latch handle adapted for rotating the cam rotating shaft and turning the single cam, which secondary latch handle and the dual action latch are displaceable relative to each other without disengaging the cam rotating shaft from the single cam.

20. The dual action latch of claim 11, further comprising a pivot pin that pivotally connects the latch handle to the self-contained latch housing.

21. A dual action latch for mounting to the outside of a door, comprising:

a movable latch handle comprising a lever arm;

an elongate bolt comprising a distal end and a proximal end, and an elongate recess with a proximal end and a distal end;

a single cam comprising a boss with a shaft engagement and a single cam plate, wherein at least a portion of the boss is sized to movably pass though the elongate recess of the elongate bolt and wherein the shaft engagement is laterally slidably engageable with a shaft, wherein the single cam is a part separate from the elongate bolt;

a self-contained latch housing to which the latch handle is movably engaged, the latch housing having a lever arm aperture through which the lever arm passes, a bolt recess for slidably receiving the elongate bolt with the bolt recess being open at one end to permit the distal end of the elongate bolt to extend outside of the latch housing, and a housing closure on a bottom of the latch housing, which housing closure has an aperture that is aligned with the shaft engagement adapted to permit external access to rotate the cam; and a biasing device which biases the elongate bolt out of the open end of the latch housing, wherein when the single cam is rotated both in a clockwise and a counterclockwise direction from outside of the latch housing the cam plate directly impinges on the elongate bolt and withdraws the elongate bolt into the latch housing, and wherein when the movable latch handle is moved the lever arm directly impinges on the proximal end of the recess of the elongate bolt and moves the elongate bolt into the latch housing and withdraws the elongate bolt into the self-contained latch housing.

22. The dual action latch of claim 21, further comprising a secondary latch handle adapted for rotating the shaft and turning the single cam which secondary latch handle and the dual action latch are displaceable relative to each other without disengaging the shaft from the single cam.

23. The dual action latch of claim 21, wherein the elongate bolt further comprises two guide rails that are positioned along both sides of an elongate recess formed therein and having a distal end, wherein the single cam plate has two engaging surfaces, and wherein when the cam is rotated in both a clockwise and a counterclockwise direction, one of the two engaging surfaces will impinge on the distal end of one of the two guide rails and push the elongate bolt into the latch housing.

24. The dual action latch of claim 21, wherein the biasing device comprises a coil spring positioned in the latch housing interposed between the proximal end of the elongate bolt and a closed end of the bolt guide opposite the open end of the bolt guide.

25. The dual action latch of claim 21, further comprising a pivot pin that pivotally connects the latch handle to the self-contained latch housing.

* * * * *